US006796129B2

(12) United States Patent
Yee et al.

(10) Patent No.: US 6,796,129 B2
(45) Date of Patent: Sep. 28, 2004

(54) DESIGN AND CONTROL STRATEGY FOR CATALYTIC COMBUSTION SYSTEM WITH A WIDE OPERATING RANGE

(75) Inventors: David K. Yee, Hayward, CA (US); Robert Anthony Corr, II, El Cajon, CA (US); Sarento George Nickolas, San Jose, CA (US)

(73) Assignee: Catalytica Energy Systems, Inc., Mountain View, CA (US)

( * ) Notice: Subject to any disclaimer, the term of this patent is extended or adjusted under 35 U.S.C. 154(b) by 90 days.

(21) Appl. No.: 10/071,749

(22) Filed: Feb. 7, 2002

(65) Prior Publication Data

US 2004/0011056 A1 Jan. 22, 2004

Related U.S. Application Data

(60) Provisional application No. 60/315,872, filed on Aug. 29, 2001.

(51) Int. Cl.[7] ..... F02C 9/16; F23R 3/40

(52) U.S. Cl. ..... 60/777; 60/723; 431/7

(58) Field of Search ..... 60/723, 777; 431/7, 431/170

(56) References Cited

U.S. PATENT DOCUMENTS

| | | | |
|---|---|---|---|
| 3,975,900 | A | 8/1976 | Pfefferle |
| 4,473,536 | A | 9/1984 | Carberg et al. |
| 4,534,165 | A | 8/1985 | Davis, Jr. et al. |
| 4,794,753 | A | 1/1989 | Beebe |
| 5,133,180 | A | 7/1992 | Horner et al. |
| 5,139,755 | A | 8/1992 | Seeker et al. |
| 5,161,366 | A | 11/1992 | Beebe |
| 5,165,224 | A | 11/1992 | Spadaccini et al. |
| 5,183,401 | A | 2/1993 | Dalla Betta et al. |
| 5,232,357 | A | 8/1993 | Dalla Betta et al. |
| 5,235,804 | A | 8/1993 | Colket, III et al. |
| 5,248,251 | A | 9/1993 | Dalla Betta et al. |
| 5,250,489 | A | 10/1993 | Dalla Betta et al. |

(List continued on next page.)

FOREIGN PATENT DOCUMENTS

| | | |
|---|---|---|
| EP | 0 453 178 | 10/1991 |
| JP | 63163716 | 7/1988 |

OTHER PUBLICATIONS

Felder, R.M. and Rousseau, R.W. (1978) *Elementary Principles of Chemical Processes.* John Wiley and Sons, New York, p. 414.

Lefebvre, A. H. (Sep. 1998). *Gas Trubine Combustion.* Hemisphere Publishing Corporation. (Table of Contents). p. 49 and 192.

Lefebvre, A. H. (Sep. 1998). *Gas Trubine Combustion.* Hemisphere Publishing Corporation. (Table of Contents). p. 48 (Fig. 2.7) and p. 192 (Fig. 6.13).

Vatcha, S.R. (1997). "Low Emission Gas Turbines Using Catalytic Combustion," *Energy Conversion and Management* 38(10–13):1327–1334.

*Primary Examiner*—Louis J. Casaregola
(74) *Attorney, Agent, or Firm*—Morrison & Foerster LLP

(57) ABSTRACT

The present additional control strategy has been developed to allow the gas turbine to operate at lower load or at other conditions where the total fuel required by the gas turbine is not optimum for full combustion of the fuel. The present invention manages air that bypasses the catalytic combustor and air that bleeds off of the compressor discharge. The bypass system changes the fuel air ratio of the catalytic combustor without affecting the overall gas turbine power output. The bleed system also changes the fuel air ratio of the catalytic combustor but at the cost of reducing the overall gas turbine efficiency. The key advantage of a catalytic combustor with a bypass and bleed system and the inventive control strategy is that it can maintain the catalyst at optimum low emissions operating conditions over a wider load range than a catalytic combustor without such a system.

12 Claims, 13 Drawing Sheets

U.S. PATENT DOCUMENTS 5,258,349 A 11/1993 Dalla Betta et al.
5,259,754 A 11/1993 Dalla Betta et al.
5,263,325 A 11/1993 McVey et al.
5,269,679 A 12/1993 Syska et al.
5,281,128 A 1/1994 Dalla Betta et al.
5,318,436 A 6/1994 Colket, III et al.
5,395,235 A 3/1995 Lan-Sun Hung
5,405,260 A 4/1995 Della Betta et al.
5,413,477 A 5/1995 Moreland
5,425,632 A 6/1995 Tsurumi et al.
5,452,574 A 9/1995 Cowell et al.
5,461,855 A 10/1995 Inoue et al.
5,461,864 A 10/1995 Betta et al.
5,474,441 A 12/1995 Farrauto et al.
5,511,972 A 4/1996 Dalla Betta et al.
5,512,250 A 4/1996 Betta et al.
5,551,869 A 9/1996 Brais et al.
5,554,021 A 9/1996 Robertson et al.
5,569,020 A 10/1996 Griffen et al.
5,581,997 A 12/1996 Janes
5,634,784 A 6/1997 Pfefferle et al.
5,729,967 A 3/1998 Joos et al.
5,826,429 A 10/1998 Beebe et al.
5,850,731 A 12/1998 Beebe et al.
5,879,148 A 3/1999 Cheng et al.
5,896,738 A 4/1999 Yang et al.
5,913,675 A 6/1999 Vago et al.
5,937,632 A 8/1999 Döbbeling et al.
5,937,634 A 8/1999 Etheridge et al.
5,957,682 A 9/1999 Kamal et al.
5,965,001 A 10/1999 Chow et al.
5,985,222 A 11/1999 Sudduth et al.
6,000,212 A 12/1999 Kolaczkowski et al.
6,038,861 A 3/2000 Amos et al.
6,066,303 A 5/2000 Sudduth et al.
6,082,111 A 7/2000 Stokes
6,089,855 A 7/2000 Becker et al.
6,094,916 A 8/2000 Puri et al.
6,095,793 A 8/2000 Greeb
6,105,360 A 8/2000 Willis
6,109,018 A 8/2000 Rostrup-Nielsen et al.
6,116,014 A 9/2000 Dalla Betta et al.
6,122,916 A 9/2000 Amos et al.
6,125,625 A 10/2000 Lipinski et al.
6,128,894 A 10/2000 Joos et al.
6,201,029 B1 3/2001 Waycuilis
6,217,832 B1 4/2001 Betta et al.
6,226,977 B1 5/2001 Ichiryu et al.
6,237,343 B1 5/2001 Butler
6,250,877 B1 6/2001 Westphal et al.
6,270,336 B1 8/2001 Terashima et al.
6,280,695 B1 8/2001 Lissianski et al.
6,286,482 B1 9/2001 Flynn et al.
6,289,667 B1 9/2001 Kolaczkowski et al.
6,298,654 B1 10/2001 Vermes et al.
6,339,925 B1 1/2002 Hung et al.
6,595,003 B2 * 7/2003 Dalla Betta et al. ..... 60/777
2001/0046650 A1 11/2001 Smith et al.
2002/0056276 A1 * 5/2002 Dalla Betta et al. ..... 60/723
2002/0083715 A1 7/2002 Dalla Betta et al.

* cited by examiner

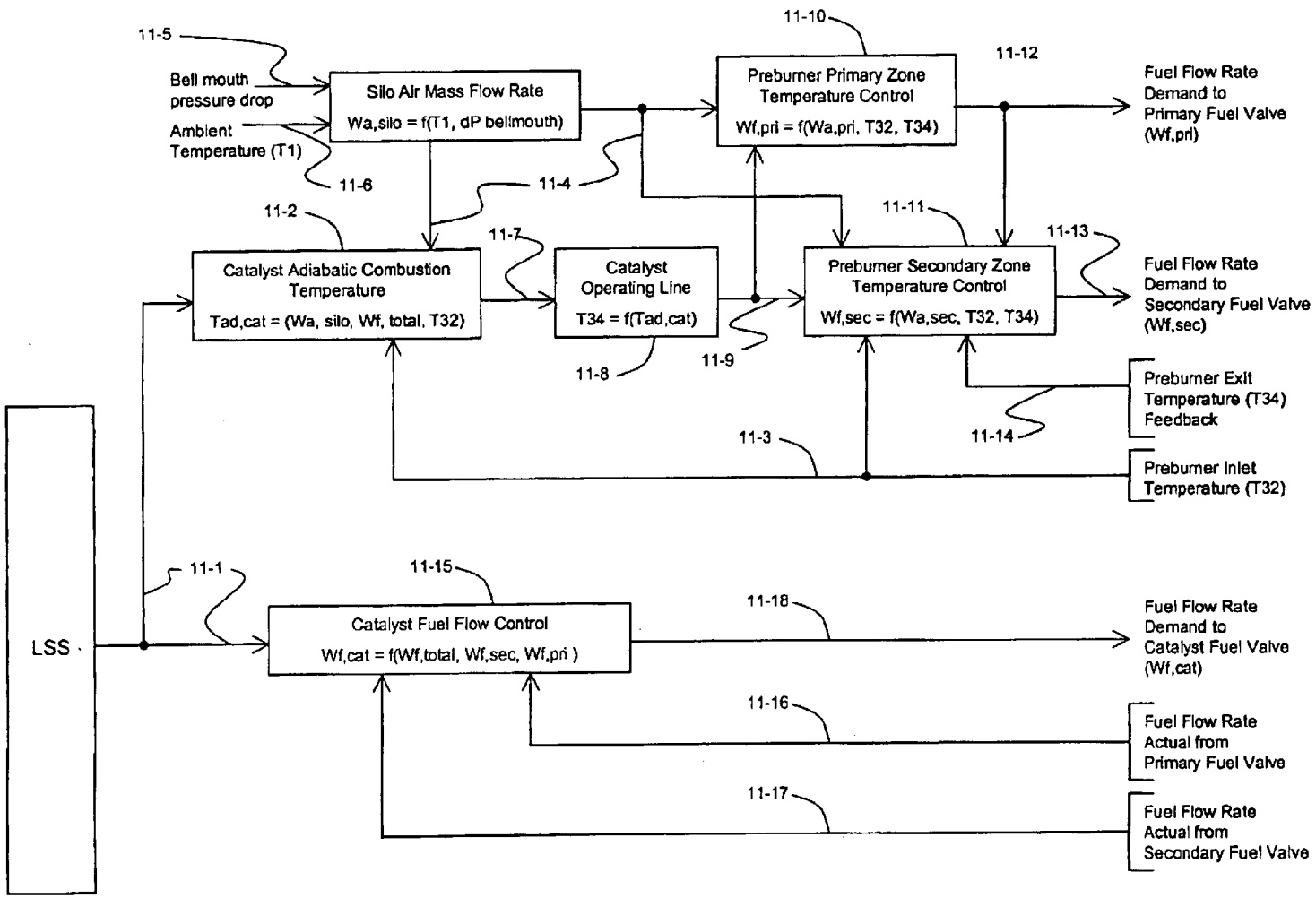
Figure 11: Basic Control with T34 vs Tad (F/A) schedule - PRIOR ART

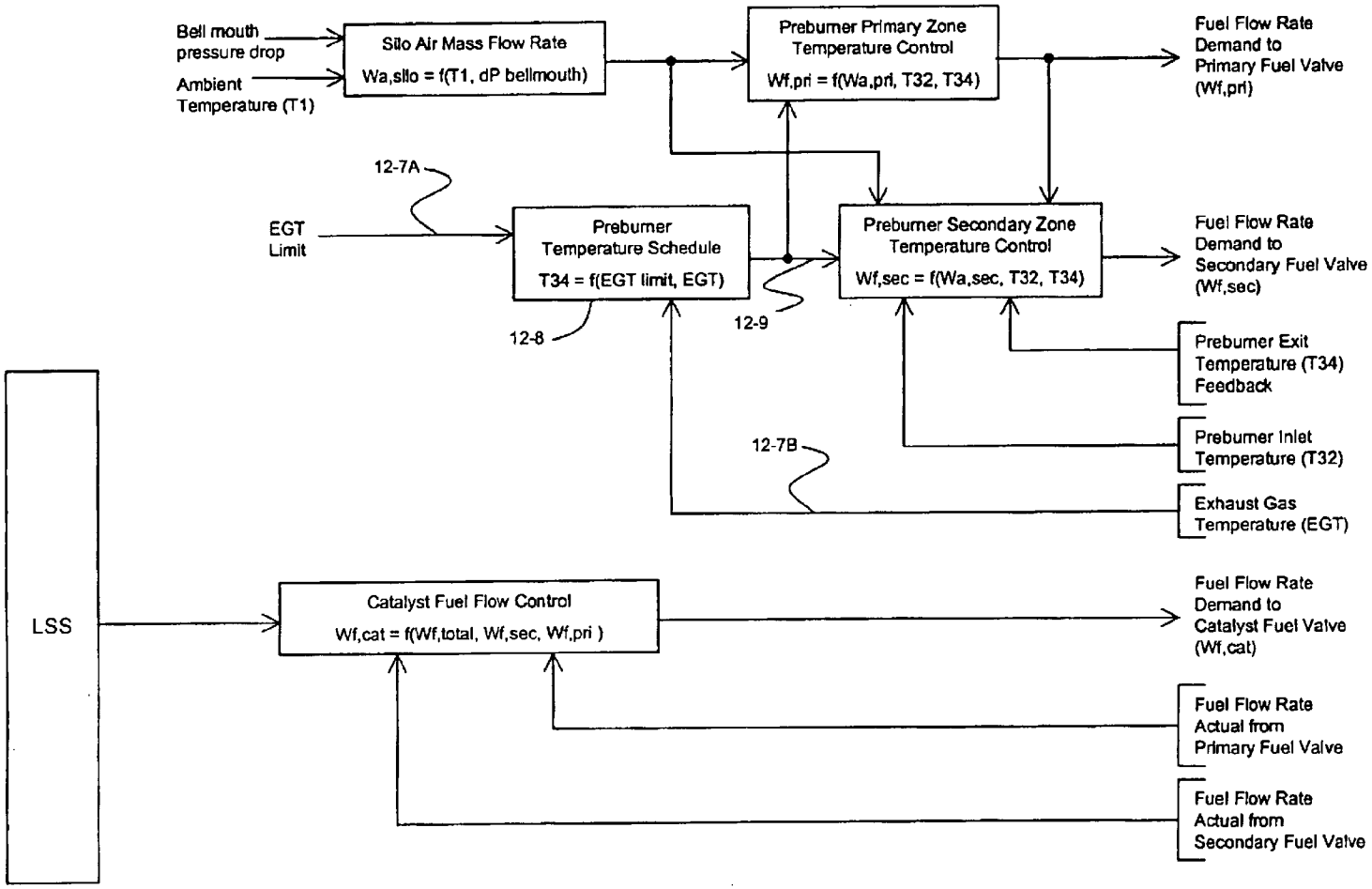
Figure 12: Basic Control with T34 vs delta EGT schedule

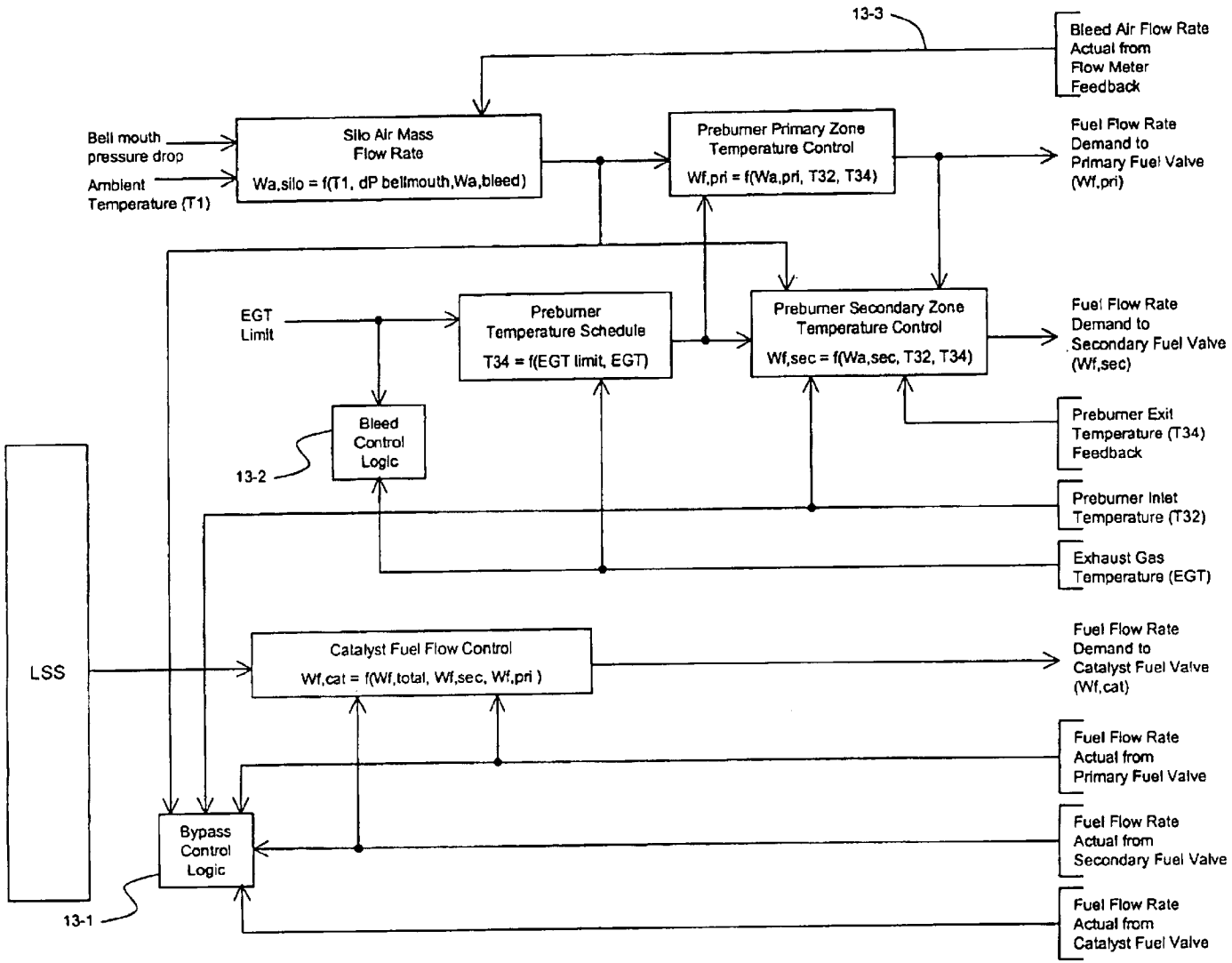
Figure 13: Control with Bypass and Bleed Valves

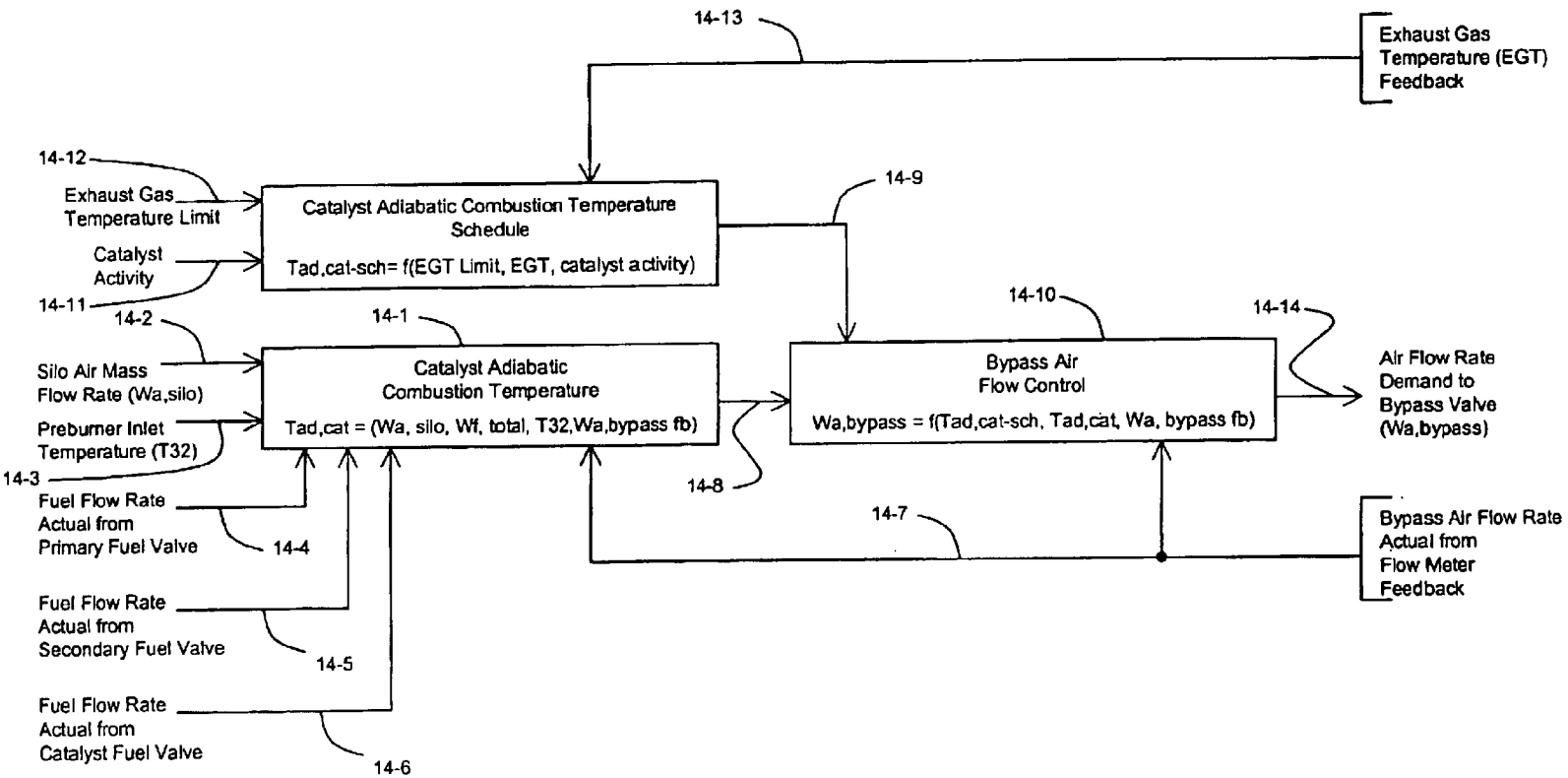
Figure 14: Bypass Control Logic Details

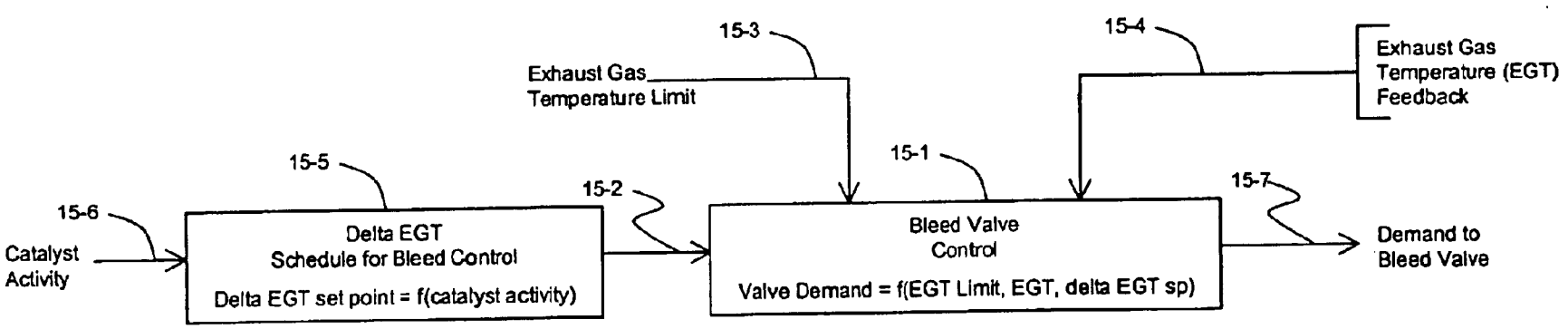
Figure 15: Bleed Control Logic Details

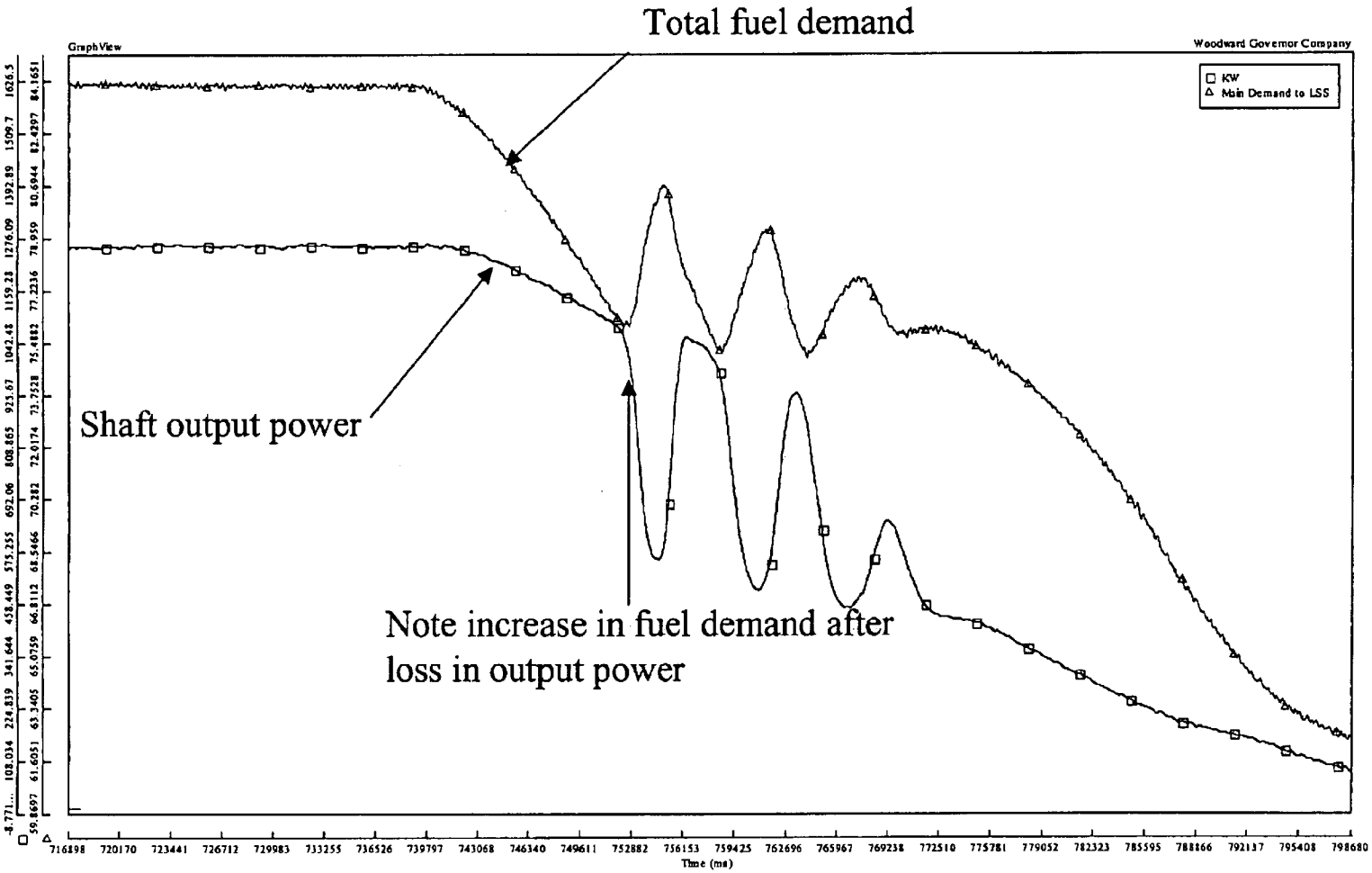
Figure 16: Output power cycles resulting from the loss and re-establishing of the homogeneous combustion process wave.

DESIGN AND CONTROL STRATEGY FOR CATALYTIC COMBUSTION SYSTEM WITH A WIDE OPERATING RANGE

CROSS-REFERENCE TO RELATED APPLICATIONS

The present application is related to and claims priority from Provisional Patent Application entitled "Design and control strategy for catalytic combustion", Ser. No. 60/315,872, filed Aug. 29, 2001, and is incorporated by reference in its entirety into the present application herewith.

FIELD OF THE INVENTION

This application relates to combustion control systems, and more particularly to dynamic, real time combustion control systems and methods for use with catalytic combustion processes, particularly as they relate to and are utilized by gas turbine engines.

BACKGROUND

In a conventional gas turbine engine, the engine is controlled by monitoring the speed of the engine and adding a proper amount of fuel to control the engine speed. Specifically, should the engine speed decrease, fuel flow is increased thus causing the engine speed to increase. Similarly, should the engine speed increase, fuel flow is decreased causing the engine speed to decrease. In this case, the engine speed is the control variable or process variable monitored for control.

A similar engine control strategy is used when the gas turbine is connected to an AC electrical grid in which the engine speed is held constant as a result of the coupling of the generator to the grid frequency. In such a case, the total fuel flow to the engine may be controlled to provide a given power output level or to run to maximum power with such control based on controlling exhaust gas temperature or turbine inlet temperature. Again, as the control variable rises above a set point, the fuel is decreased. Alternatively, as the control variable drops below the set point, the fuel flow is increased. This control strategy is essentially a feedback control strategy with the fuel control valve varied based on the value of a control or process variable compared to a set point.

In a typical combustion system using a diffusion flame burner or a simple lean premixed burner, the combustor has only one fuel injector. In such systems, a single valve is typically used to control the fuel flow to the engine. In more recent lean premix systems however, there may be two or more fuel flows to different parts of the combustor, with such a system thus having two or more control valves. In such systems, closed loop control is based on controlling the total fuel flow based on the required power output of the gas turbine while fixed (pre-calculated) percentages of flow are diverted to the various parts of the combustor. The total fuel flow will change over time. In addition, the desired fuel split percentages between the various fuel pathways (leading to various parts of the combustor) may either be a function of certain input variables or they may be based on calculation algorithm using process inputs such as temperatures, airflow, pressures etc. Such control systems offer ease of control due primarily to the very wide operating ranges of these conventional combustors and the ability of the turbine to withstand short spikes of high temperature without damage to various turbine components. Moreover, the fuel/air ratio fed to these combustors may advantageously vary over a wide range with the combustor remaining operational. A wide variety of such control strategies can be employed and a number of these have been described in the literature.

A properly operated catalytic combustion system can provide significantly reduced emissions levels, particularly of NOx. Unfortunately, however, such systems may have a much more limited window of operation compared to conventional diffusion flame or lean premix combustors. For example, fuel/air ratios above a certain limit may cause the catalyst to overheat and lose activity in a very short time. In addition, the inlet temperature may have to be adjusted as the engine load is changed or as ambient temperature or other operating conditions change.

SUMMARY

In accordance with one aspect of the invention, there is provided a method of controlling a catalytic combustion system. The catalytic combustion system comprises an air supply, a flame burner, a fuel injector positioned downstream of the flame burner and a catalyst positioned downstream of the fuel injector. A flow path containing a valve directs a portion of the airflow to bypass the catalyst. A portion of the fuel combusts within the catalyst and a remainder of the fuel combusts in the region downstream of the catalyst. The method includes the steps of determining the adiabatic combustion temperature at the catalyst inlet, and adjusting the airflow that bypasses the catalyst to maintain the adiabatic combustion temperature at the catalyst inlet within a predetermined range.

In accordance with another aspect of the invention, there is provided a method of controlling a catalytic combustion system. The catalytic combustion system comprises an air supply, a flame burner, a fuel injector positioned downstream of the flame burner and a catalyst positioned downstream of the fuel injector. A flow path containing a valve directs a portion of the airflow to bypass the catalyst. A portion of the fuel combusts within the catalyst and a remainder of the fuel combusts in the region downstream of the catalyst. The method includes the steps of determining the adiabatic combustion temperature at the catalyst inlet, measuring the exhaust gas temperature, calculating the exhaust gas temperature at full load, and adjusting the airflow that bypasses the catalyst to maintain the adiabatic combustion temperature at the catalyst inlet based upon a predetermined schedule. The predetermined schedule relates the i) adiabatic combustion temperature at the catalyst inlet to ii) the difference between the measured exhaust gas temperature and the calculated exhaust gas temperature at full load.

In accordance with yet another aspect of the invention, there is provided a method of controlling a catalytic combustion system. The catalytic combustion system comprises an air supply, a flame burner, a fuel injector positioned downstream of the flame burner and a catalyst positioned downstream of the fuel injector. A flow path containing a valve directs a portion of the airflow to bypass the catalyst. A portion of the fuel combusts within the catalyst and a remainder of the fuel combusts in the region downstream of the catalyst. The method includes the steps of determining the adiabatic combustion temperature at the catalyst inlet, measuring the load, calculating full load, and adjusting the airflow that bypasses the catalyst to maintain the adiabatic combustion temperature at the catalyst inlet based upon a predetermined schedule. The predetermined schedule relates the i) adiabatic combustion temperature at the catalyst inlet to ii) the difference between the measured load and the calculated full load.

In accordance with another aspect of the invention, there is provided a method of controlling a catalytic combustion process consisting of a combustion zone through which air is flowed. The process includes a fuel injection means to provide fuel to a catalyst and one or more catalyst sections wherein a portion of the fuel is combusted within the catalyst. The remaining fuel exits the outlet face of the catalyst and combusts in a homogeneous combustion reaction in the space downstream of said catalyst outlet face. The process also includes a bypass system operation that is based on engine output power to maximize the low emissions operating range of said catalyst. The bypass valve closed loop control is based on a flow measuring device.

In accordance with another aspect of the invention, there is provided a method of controlling a catalytic combustion process consisting of a combustion zone through which air is flowed. The process includes fuel injection means to provide fuel to a catalyst and one or more catalyst sections wherein a portion of the fuel is combusted within the catalyst. The remaining fuel exits the outlet face of the catalyst and combusts in a homogeneous combustion reaction in the space downstream of said catalyst outlet face. The bypass system operation is based on fundamental engine performance measurements such as exhaust gas temperature, ambient temperature, compressor discharge pressure, and compressor discharge temperature. The bypass valve closed loop control is based on the valve's feedback position.

In accordance with another aspect of the invention, there is provided a method of controlling a catalytic combustion process consisting of a combustion zone through which air is flowed. The process includes a fuel injection means to provide fuel to a catalyst and one or more catalyst sections wherein a portion of the fuel is combusted within the catalyst. The remaining fuel exits the outlet face of the catalyst and combusts in a homogeneous combustion reaction in the space downstream of said catalyst outlet face. A bleed system operation is based on exhaust gas temperature to maximize the low emissions operating range of said catalyst. The bleed valve closed loop control is based on exhaust gas temperature.

In accordance with another aspect of the invention, there is provided a method of controlling a catalytic combustion process consisting of a combustion zone through which air is flowed. The process includes a fuel injection means to provide fuel to a catalyst and one or more catalyst sections wherein a portion of the fuel is combusted within the catalyst. The remaining fuel exits the outlet face of the catalyst and combusts in a homogeneous combustion reaction in the space downstream of said catalyst outlet face. A bypass system operation is based on engine output power to maximize the low emissions operating range of said catalyst. A bleed system operation is based on exhaust gas temperature to further increase the low emissions operating range of the catalyst. The bypass valve closed loop control is based on a flow measuring device. The bleed valve closed loop control is based on exhaust gas temperature.

In accordance with another aspect of the invention, there is provided a method of controlling a catalytic combustion system comprising a combustor having an air supply, a flame burner, a fuel injector positioned downstream of the flame burner and a catalyst positioned downstream of the fuel injector. A flow path containing a valve directs a portion of the airflow to bypass the catalyst, wherein a portion of the fuel combusts within the catalyst and a remainder of the fuel combusts in the region downstream of the catalyst. The method includes the steps of measuring at least one thermodynamic combustion system parameter, selecting a first predetermined schedule that relates the at least one thermodynamic combustion system parameter to a predetermined airflow that bypasses the catalyst, and controlling the airflow that bypasses the catalyst by selecting the predetermined airflow that bypasses the catalyst from the first predetermined schedule based on the at least one measured thermodynamic combustion system parameter.

In accordance with another aspect of the invention, there is provided a method of controlling a catalytic combustion system comprising a combustor having an air supply, a flame burner, a fuel injector positioned downstream of the flame burner and a catalyst positioned downstream of the fuel injector. A flow path containing a valve bleeds combustor inlet air flow. A portion of the fuel combusts within the catalyst and a remainder of the fuel combusts in the region downstream of the catalyst. The method includes the steps of measuring at least one thermodynamic combustion system parameter, selecting a first predetermined schedule that relates the at least one thermodynamic combustion system parameter to a predetermined airflow that bleeds combustor inlet air flow, and controlling the airflow that bleeds combustor inlet air flow by selecting the predetermined airflow that bleeds combustor inlet air flow from the first predetermined schedule based on the at least one measured thermodynamic combustion system parameter.

BRIEF DESCRIPTION OF THE DRAWINGS

The foregoing and other advantages of the invention will become apparent upon reading the following detailed description and upon reference to the drawings in which:

FIG. 11 is a schematic diagram of functional elements for a prior art control strategy for a catalytic combustion system;

FIG. 12 is a schematic diagram of functional elements for a control strategy for a catalytic combustion system of the present invention;

FIG. 13 is a schematic diagram of functional elements for a control strategy for a catalytic combustion system incorporating bypass and bleed controls of the present invention;

FIG. 14 is a schematic diagram of the functional elements for a bypass control strategy for a catalytic combustion system of the present invention;

FIG. 15 is a schematic diagram of the functional elements for a bleed control strategy for a catalytic combustion system of the present invention; and FIG. 16 is a graph of shaft output and total fuel demand versus time resulting from the repeated cycles of re-establishing and losing the homogeneous combustion process wave.

Figure 1:
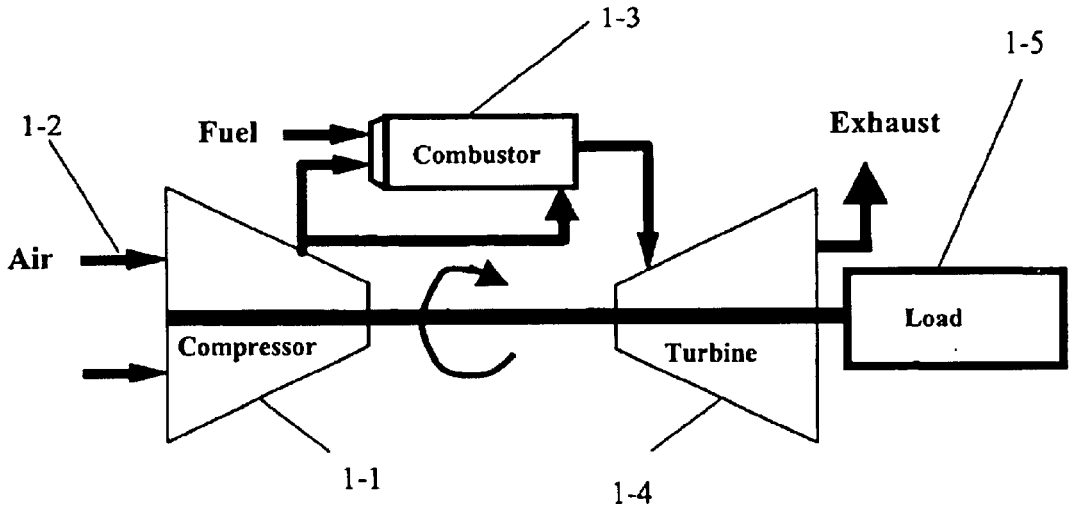
Fig 1 (PRIOR ART)
FIG. 1 is a diagram of a gas turbine system.

While the invention is susceptible to various modifications and alternative forms, specific variations have been shown by way of example in the drawings and will be described herein. However, it should be understood that the invention is not limited to the particular forms disclosed. Rather, the invention is to cover all modifications, equivalents, and alternatives falling within the spirit and scope of the invention as defined by the appended claims.

DETAILED DESCRIPTION OF THE INVENTION

FIG. 1 schematically shows an example of a typical existing gas turbine employing a catalytic combustion system. In this system, compressor 1-1 ingests ambient air 1-2 through compressor bellmouth, and compresses this air to a high pressure and then drives the compressed air, at least in part, through the combustor 1-3 and then through the drive turbine 1-4. Combustor 1-3 combines fuel and the air and combusts this mixture to form a hot high velocity gas stream that flows through the turbine 1-4 that provides the power to drive the compressor 1-1 and the load 1-5 such as a generator.

Figure 2:
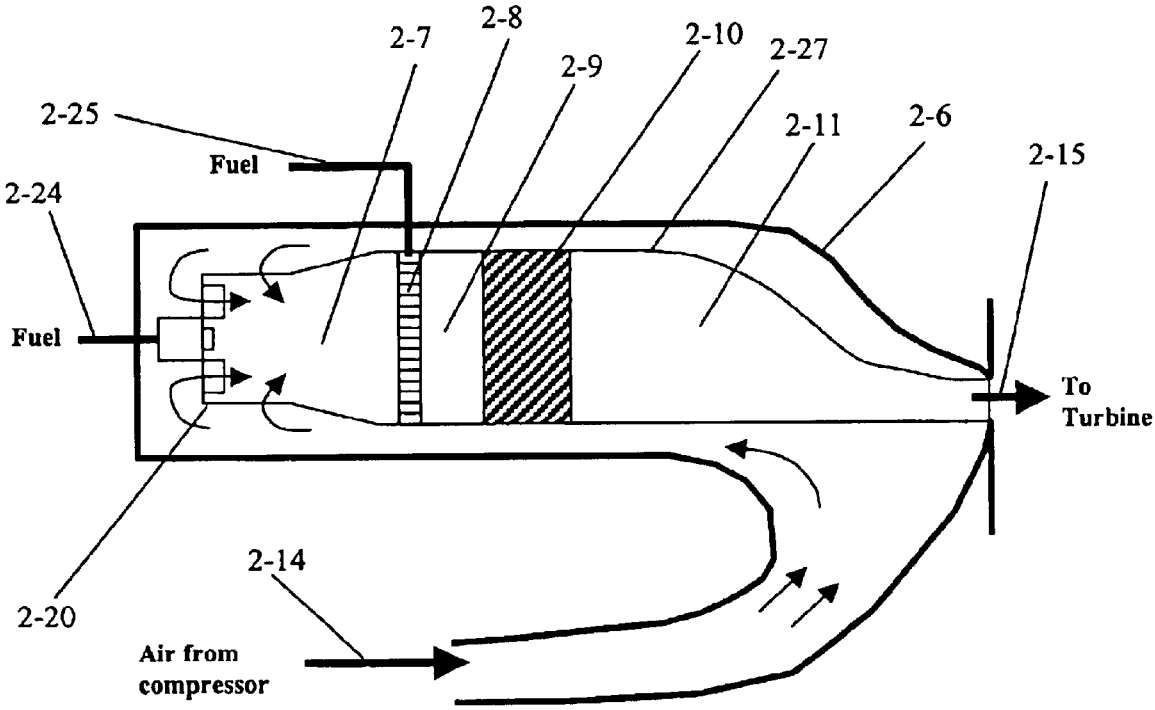
FIG. 2 is a diagram of a catalytic combustion system.

FIG. 2 is a close-up view of combustor 1-3 of FIG. 1. Specifically, as shown in FIG. 2, a catalytic combustor 2-6 is provided. Catalytic combustor 2-6 comprises four major elements that are arrayed serially in the flow path. Specifically, these four elements include a flame burner 2-20 (which is positioned upstream of the catalyst and which produces a hot gas mixture 2-7), a fuel injection and mixing system 2-8, a catalyst 2-10 and a burnout zone 2-11. The flame burner can be divided into multiple zones, such as a primary zone preburner and a secondary zone preburner (not shown). The exiting hot gases from the combustion system flow into the drive turbine 2-15 that produces power to drive a load. In preferred aspects, there are two independently controlled fuel streams, with one stream 2-24 directed to a flame burner 2-20 and the other stream 2-25 being directed to the catalyst fuel injection and mixing system 2-8, as shown. If multiple preburner zones are employed then fuel streams to each are controlled accordingly.

Catalytic combustor 2-6 operates in the following manner. The majority of the air from the gas turbine compressor discharge 2-14 flows through the flame burner 2-20 and catalyst 2-10. Flame burner 2-20 functions to help start up the gas turbine and to adjust the temperature of the air and fuel mixture to the catalyst at location 2-9 to a level that will support catalytic combustion of the main fuel stream 2-25, which is injected and mixed with the flame burner discharge gases (by catalyst fuel injection and mixing system 2-25) prior to entering catalyst 2-10. In various aspects, catalyst 2-10 may consist of either a single stage or a multiple stage catalyst.

Partial combustion of the fuel/air mixture occurs in catalyst 2-10, with the balance of the combustion then occurring in the burnout zone 2-11, (i.e.: downstream of the exit face of catalyst 2-10). Typically, 10%–90% of the fuel is combusted in catalyst 2-10. Preferably, to fit the general requirements of the gas turbine operating cycle including achieving low emissions, while obtaining good catalyst durability, 20%–70% is combusted in catalyst 2-10, and most preferably between about 30% to about 60% is combusted in catalyst 2-10.

Figure 3:
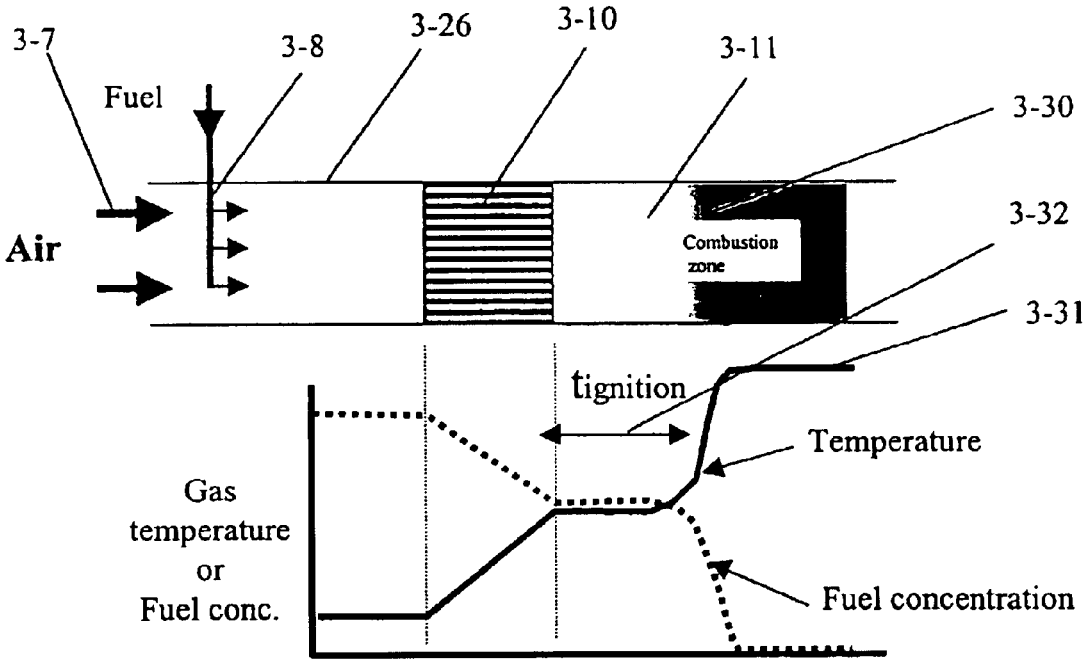
FIG. 3 is a diagram of a catalytic combustion system with associated temperature and fuel concentration profiles.

Reaction of any remaining fuel not combusted in the catalyst and the reaction of any remaining carbon monoxide to carbon dioxide occurs in burnout zone 2-11, thereby advantageously obtaining higher temperatures without subjecting the catalyst to these temperatures and obtaining very low levels of unburned hydrocarbons and carbon monoxide. After complete combustion has occurred in burnout zone 2-11, any cooling air or remaining compressor discharge air is then introduced into the hot gas stream, (i.e.: at 2-15, typically just upstream of the turbine inlet). In addition, if desired, air can optionally be introduced through liner wall 2-27 at a location close to the turbine inlet 2-15 as a means to adjust the temperature profile to that required by the turbine section at location 2-15. Such air introduction to adjust the temperature profile is one of the design parameters for power turbine 2-15. Another reason to introduce air through liner 2-27 in the region near the turbine 2-15 would be for turbines with very low inlet temperatures at 2-15. For example, some turbines have turbine inlet temperatures in the range of 900 to 1100° C., temperatures too low to completely combust the remaining unburned hydrocarbons and carbon monoxide within the residence time of the burnout zone 2-11. In these cases, a significant fraction of the air can be diverted through the liner 2-27 in the region near turbine 2-15. This would raise the temperature in region 2-11 thus allowing fast and complete combustion of the remaining fuel and carbon monoxide. FIG. 3 shows an example of a typical existing partial combustion catalyst system corresponding to the system shown in FIGS. 1 and 2. In such systems, only a portion of the fuel is combusted within the catalyst and a significant portion of the fuel is combusted downstream of the catalyst in a post catalyst homogeneous combustion zone. Examples of partial combustion catalyst systems and approaches to their use have been described in prior patents, for example: U.S. Pat. No. 5,183,401 to Dalla Betta et al.; U.S. Pat. No. 5,232,357 to Dalla Betta et al.; U.S. Pat. No. 5,250,489 to Dalla Betta et al.; U.S. Pat. No. 5,281,128 to Dalla Betta et al.; and U.S. Pat. No. 5,425,632 to Tsurumi et al.

In the description of such partial combustion catalytic systems set forth herein, the following terms are understood to have the following meanings:

(1) "Adiabatic combustion temperature" is the temperature of a fuel and air mixture after all of the fuel in the mixture has been combusted with no thermal energy lost to the surroundings, with the thermal energy instead being used to raise the temperature of the components of the gas mixture.

(2) "Fuel air ratio" is the ratio of the total fuel to total air expressed as either a volumetric ratio or a mass ratio. This ratio can be calculated either from the composition of a static or fixed gas mixture as the actual mixture composition or from a flowing gas mixture as the ratio of flows of fuel and air.

(3) "Post catalyst reaction zone" is the portion of the flow path just downstream of the catalyst but before any additional air introduction and before the turbine where the gas mixture exiting the catalyst can undergo further reaction.

(4) "Ignition delay time" ($T_{ignition}$) is the time period from when the hot gases exit the catalyst until they fully combust the remaining fuel content.

(5) "Homogeneous combustion zone" or "Homogeneous combustion process wave" is the region downstream of the catalyst wherein the remaining uncombusted fuel exiting the catalyst is combusted.

(6) "Exhaust gas temperature" is the temperature of the gas mixture exiting the process after the work has been extracted. In the case of a gas turbine, this is the temperature of the gas just downstream of the power turbines typically connected to the load.

(7) "Exhaust gas temperature delta" ($EGT_{delta}$) is the numerical difference between the exhaust gas temperature at any time and the calculated exhaust gas temperature at full load.

In FIG. 3, (which is a linear schematic representation of a typical partial combustion catalytic system with the gas temperature and fuel concentrations at various locations along the flow path shown there below), air 3-7 enters a fuel injection and mixing system 3-8 which injects fuel into the flowing air stream.

A portion of the fuel is combusted in the catalyst 3-10 resulting in an increase in temperature of the gas mixture as it passes through catalyst 3-10. As can be seen, the mixture exiting catalyst 3-10 is at an elevated temperature. This fuel/air mixture contains remaining unburned fuel which undergoes auto-ignition in the post catalyst reaction zone 3-11. Specifically, the fuel is combusted to form the final reaction products of $CO_2$ and $H_2O$ with the temperature rising to the final combustion temperature 3-31 at homogeneous combustion process wave 3-30. The resulting hot, high energy gases (in post catalyst reaction zone 3-11) then drive the power turbine (1-4 in FIG. 1) and load (1-5 in FIG. 1).

The lower portion of FIG. 3 shows a graph with the gas temperature indicated on the ordinate with the position along the combustor indicated on the abscissa and with the position corresponding to the linear combustor diagram directly above it. As can be seen, the gas temperature shows a rise as the mixture passes through catalyst 3-10. Downstream of catalyst 3-10, however, the mixture temperature is constant for some period, referred to as the ignition delay time 3-32, $T_{ignition}$, and then the remaining fuel combusts (at homogeneous combustion process wave 3-30) to raise the temperature further.

FIGS. 4A, 4B and 4C are similar to FIG. 3, but show a homogeneous combustion process wave (4-30) at three different locations, as follows. As illustrated in FIG. 4A, the preferred position of homogeneous combustion wave 4-30 is within the region just downstream of catalyst 4-10.

The Applicants have found that the position of the homogeneous combustion process wave is not connected to a physical process or a fixed flame holder, but rather is a function of catalyst exit gas conditions.

In accordance with the present invention, therefore, such catalyst exit conditions are controlled such that the position of the homogeneous combustion process wave can be moved and maintained at a preferred location within the post catalyst reaction zone. Preferably, the homogeneous combustion wave is located just downstream of the catalyst but is not so far downstream that a long reaction zone or volume is required. The location of the homogeneous combustion process wave is controlled by increasing the catalyst outlet temperature to move it closer to the catalyst or decreasing the catalyst outlet temperature to move it farther downstream from the catalyst. In this way, the present control system advantageously keeps the catalyst operation within a preferred operating regime for good catalyst durability while maintaining low emissions. Specifically, when operating in such a preferred operating regime, emissions of NOx, CO and unburned hydrocarbons can all be reduced while the durability of the catalyst can be maintained.

In accordance with the present invention, the conditions within the gas turbine catalytic combustor system are controlled such that the position of homogeneous combustion process wave 4-30 (similar to 3-30 of FIG. 3) can be maintained in a preferred location within the post catalyst reaction zone. FIG. 4A illustrates the homogeneous combustion wave 4-30 positioned at a desired location downstream of catalyst 4-10 with the actual location of combustion wave 4-30 controlled by the magnitude of the ignition delay time, $T_{ignition}$ (refer to FIG. 3). As the ignition delay time, $T_{ignition}$, is made longer, homogeneous combustion wave 4-30 moves downstream toward turbine 4-4 as shown in FIG. 4B. If homogeneous combustion wave 4-30 moves too close to turbine 4-4, then the remaining fuel and carbon monoxide may not have time to fully combust and the emissions will be high. This represents a limiting operating condition for the catalytic combustion system. As such, FIG. 4B illustrates a non-preferred location for combustion wave 4-30. Conversely, as ignition delay time, $T_{ignition}$, is decreased, homogeneous combustion wave 4-30 moves toward catalyst 4-10 and the unburned portions of the fuel will have sufficient time to combust, thereby producing low emissions of hydrocarbons and carbon monoxide. This is shown in FIG. 4A. However, ignition delay time, $T_{ignition}$, cannot be reduced so much that homogeneous combustion wave 4-30 moves too close to catalyst 4-10 as shown in FIG. 4C (or inside catalyst 4-10), because this would expose catalyst 4-10 to temperatures too high for efficient catalyst operation and result in some reduction in its durability. As such, FIG. 4C illustrates a potentially non-preferred or limiting location for combustion wave 4-30.

In accordance with the present invention, the catalytic combustor system is controlled such that the position of homogeneous combustion wave 4-30 is maintained within a preferred range by operating the system at a point on a preferred predetermined schedule of data points (i.e. operating line), wherein the preferred operating line is predetermined by the operating conditions of the catalytic combustor and by the catalyst performance.

In preferred aspects, control of the position of the homogeneous combustion wave 4-30 is achieved by controlling the percentages (and, optionally, the total amount) of fuel sent to the flame burner (e.g.: fuel line 2-24 and flame burner 2-20 of FIG. 2) and the catalyst fuel injection and mixing system (e.g.: fuel line 2-25 and fuel injection system 2-8 of FIG. 2). For example, adding fuel to 2-24 burned more fuel in the flame burner 2-20 and raises the temperature of the gas mixture at location 2-9, the catalyst inlet. This raises the temperature at the catalyst outlet and moves the wave upstream. Adding fuel at 2-8 changes the fuel/air ratio at 2-9 which will also shift the wave upstream.

For a gas turbine/catalyst combustion system of the type shown in FIG. 2, and for a given range of system operating conditions such as pressure, airflow and fuel composition and for a specific catalyst design, there will be a characteristic "Operating Diagram", wherein a line of points on this diagram represents an "operating line" which corresponds to conditions of lowest emissions. Such an operating line diagram can initially be determined in a number of different ways.

Figure 5A:
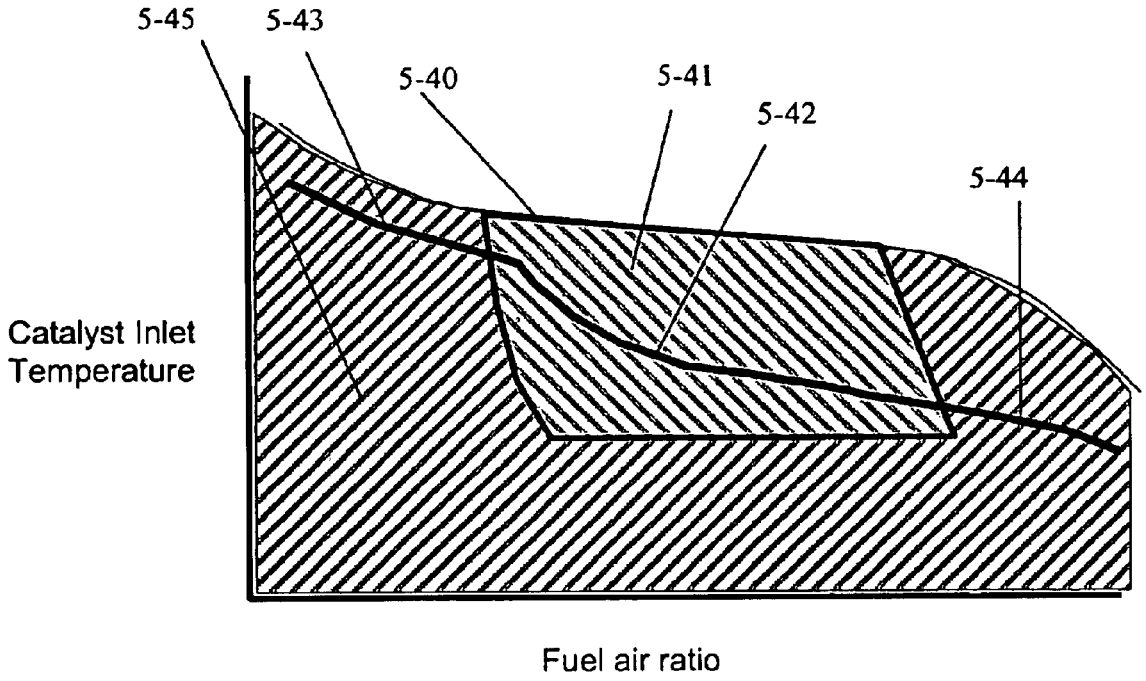
FIG. 5A is a graph of catalyst inlet temperature versus fuel-to-air ratio depicting an operating window diagram for a catalytic combustion system.
Figure 5B:
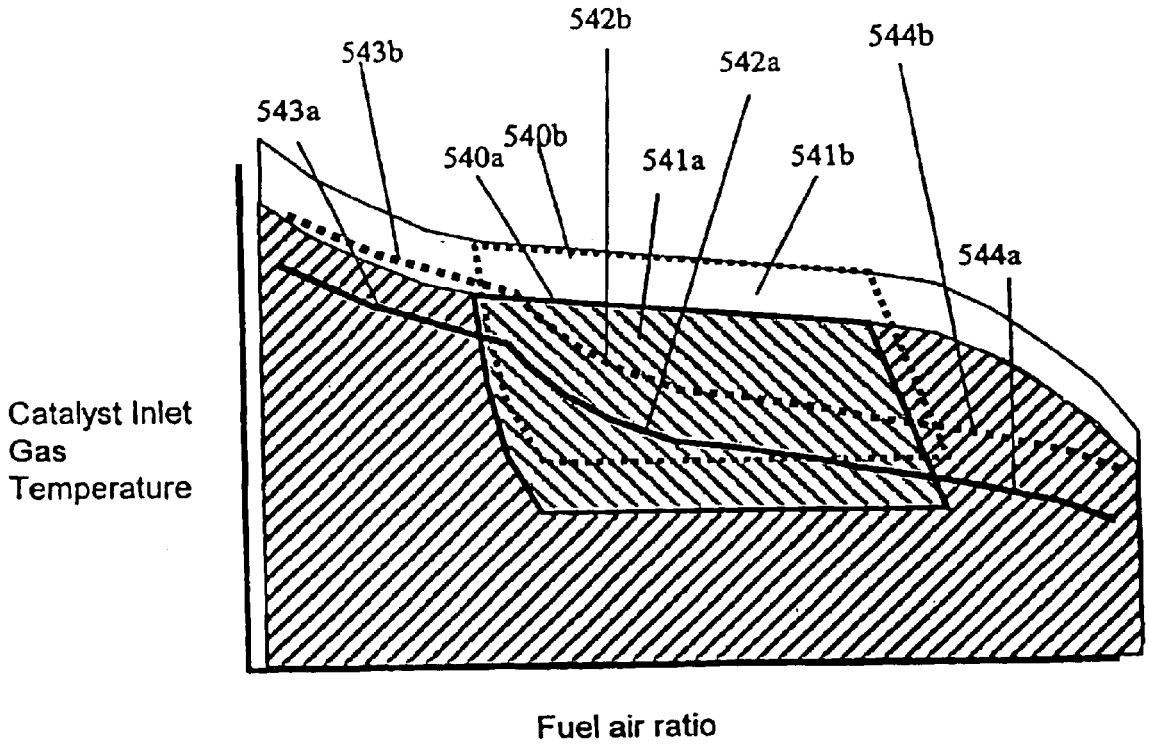
FIG. 5B is a graph of catalyst inlet temperature versus fuel-to-air ratio depicting a shift in the operating window for a catalytic combustion system.

In a first approach, the catalyst unit may be operated on the actual gas turbine or the gas turbine can be simulated using a full scale combustor test rig or using a subscale combustor test rig. Referring to FIG. 5A, a fuel air ratio value is selected to be in the desired region of operation of the gas turbine at some point along the abscissa of FIG. 5A. The catalyst inlet gas temperature is then increased by adding fuel to the upstream flame burner until emissions and system performance is acceptable. If this fuel air ratio is within the region 5-41 then the bottom limit of region 5-41 is established by low emissions for CO and UHC. As the catalyst inlet gas temperature is increased further, then the upper limit of region 5-41 is reached when the catalyst material operating temperature is too high for adequate durability. This process can be repeated for several other values of fuel air ratio and the limits of region 5-41 can thus be defined. The actual preferred schedule of operating line points (i.e.: the schedule of most preferred operating conditions) can then be established within region 5-41 by taking into account other variables such as the operating characteristics of the upstream flame combustor or durability of upstream components such as the fuel air mixer 2-8 in FIG. 2. Once the basic operating line diagram of FIG. 5A represented by line 5-43, 5-42 and 5-44 (using the variables of fuel air ratio and catalyst inlet gas temperature) has been determined, the fuel air ratio can be converted into combustor outlet temperature or turbine inlet temperature or adiabatic combustion temperature using well known relationships. Therefore, the operating schedule is expressed as the catalyst inlet gas temperature (T36) versus the fuel air ratio, or as the catalyst inlet gas temperature (T36) versus the calculated adiabatic combustion temperature (Tad) that is calculated or measured. Instead of the catalyst inlet gas temperature (T36), the operating schedule can also be expressed in terms of the temperature at location 2-7 (T34) which can be measured or calculated from the catalyst inlet gas temperature (T36), the mass gas flow rate at location 2-7 and the fuel flow 2-25.

In another approach, the operating window and the preferred operating line schedule can be calculated based on performance models of the catalyst where the emissions and catalyst material operating temperature are calculated. Therefore, the operating schedule can be expressed such that the temperature at the catalyst exit (T37), or the temperature rise across the catalyst (T37–T36) is employed in place of catalyst inlet gas temperature (T36) plotted against any of the parameters indicated above.

In yet another approach, an operating diagram and operating line can be constructed using values of EGT (exhaust gas temperature) delta and catalyst inlet gas temperature taken from measurements on the gas turbine. The $EGT_t$ value may be measured at the process exhaust (i.e.: downstream of turbine 1-4). The $EGT_{full\ load\text{-}t}$ value may then be calculated, and the EGT $delta_t$ value may be calculated by subtracting $EGT_t$ from $EGT_{full\ load\text{-}t}$. Hence, the operating schedule is expressed as the catalyst inlet gas temperature (T36) versus EGT delta; the temperature at location 2-7 (T34) versus EGT delta; the temperature at the catalyst exit (T37) or the temperature rise across the catalyst (T37–T36) versus EGT delta; or the fuel-air ratio versus EGT delta.

In this approach, the catalyst is operated at various loads and measurements are made on the catalyst to insure that it is in an optimal operating regime and that low emissions are achieved. Then $EGT_t$, EGT $delta_t$ and $EGT_{full\ load\text{-}t}$ are measured or calculated. This is repeated over the operating load range to establish the operating line. An alternative approach is to use the thermodynamic cycle simulation of the gas turbine and the air splits of the combustor system to actually calculate the catalyst fuel air ratio and the EGT delta. This can be done over the operating load range to define the operating line.

In another approach, the operating schedule is expressed as either the catalyst inlet gas temperature (T36), the temperature at location 2-7 (T34), the temperature at the catalyst exit (T37), or the temperature rise across the catalyst (T37–T36) versus the turbine inlet temperature or its equivalents that are measured or calculated. The turbine inlet temperature can be determined by direct measurement using a thermocouple or with optical pyrometry. For example, an ultraviolet sensor such as a silicon carbide semiconductor ultraviolet radiation sensitive photodiode can be used. Also, turbine inlet temperature can be determined by obtaining the temperature of a specific turbine location either by direct measurement or calculation and then back-calculating the value for the turbine inlet temperature. The calculation includes other inputs such as fuel flow, inlet airflow and ambient temperature. Specific turbine locations for temperature measurement include but are not limited to the turbine exhaust temperature or exhaust gas temperature, an intermediate location of the turbine but upstream of the exhaust such as between a turbine rotor and stator, and a location between the gas generator turbine and power turbine in a dual-shaft turbine.

It is to be understood that in accordance with the present invention, an "operating diagram" can be used to illustrate the relationship between any two system variables that effectively defines the correct operating regime for the catalyst and post catalyst combustion region, wherein the operating line on such diagram corresponds to conditions of lowest emissions and good system durability.

As explained above, in one preferred aspect of the present invention, the "operating diagram" illustrates the relationship between the catalyst inlet gas mixture temperature (shown along the Y-axis) and the fuel air ratio (shown along the X-axis) of the mixture at the catalyst inlet. In accordance with the present invention, catalyst inlet gas temperature and fuel air ratio can be maintained in a preferred relationship such that the system operates in the low emissions region 5-41 as shown in FIG. 5A. Most preferably, system control is preferably maintained by operating the system at positions along the preferred operating line 5-42. In preferred aspects, for any given fuel air ratio, the system will be operated so that the catalyst inlet gas temperature is maintained at (or near) a value along operating line 5-42.

The alternate preferred approach, in which the operating line 5-42 is selectively determined by defining a preferred relationship between adiabatic combustion temperature (Tad) and catalyst inlet gas temperature will now be discussed. The combustor outlet temperature can be calculated from the catalyst inlet gas temperature and the composition of the fuel/air mixture at the catalyst inlet assuming that all of the fuel is combusted. Referring to FIG. 2, the catalyst inlet gas temperature at location 2-9 and the fuel air ratio at location 2-9 can be used to calculate the temperature at location 2-11 assuming all of the fuel is combusted. This temperature is referred to as the adiabatic combustion temperature or sometimes as the adiabatic flame temperature as described by Felder and Rousseau, page 4—4 (R. M. Felder and R. W. Rousseau, "Elementary Principles of Chemical Processes", John Wiley and Sons, New York, 1978). This calculation, fully described in this reference, uses the known heat of combustion of the fuel or fuel components, the heat capacities of the components of the gas mixture, the composition of the gas mixture and the temperature of the gas mixture to determine the gas temperature after full combustion of the fuel and release of the combustion heat into the gas mixture. This gas temperature is called the adiabatic combustion temperature since it is the temperature rise from the adiabatic release of the heat of combustion (adiabatic meaning that no heat is lost to the external components but is all captured by the gas mixture to raise its temperature).

For a given catalyst inlet gas temperature and mixture fuel air ratio, this calculation will result in a unique adiabatic combustion temperature, referred to as Tad. Thus, a diagram such as FIG. 5A can be redrawn wherein the horizontal axis is now the adiabatic combustion temperature, Tad and operating line 5-42, 5-43 and 5-44 relates the catalyst inlet gas temperature to the adiabatic combustion temperature of the gas mixture.

Rather than use a calculated temperature at location 2-11 in FIG. 2, the actual temperature can be measured in region 2-11 after the remaining fuel exiting the catalyst has been combusted using a variety of means such as thermocouples, optical sensors and other devices. In addition, a temperature further downstream in the process can be measured and then the combustor outlet temperature calculated assuming temperature losses in the intervening stages. For example, the temperature at the turbine inlet 2-15 can be measured and then corrected for any added pattern or cooling air to estimate the temperature at location 2-11.

The adiabatic combustion temperature at location 2-11 in FIG. 2 can also be calculated from the temperature of the gas stream at location 2-14, the airflow through the combustor at location 2-9 and the sum of the fuel inputs at 2-24 to the flame burner 2-20 and fuel input 2-25 to fuel air mixer 2-8. Thus, the desired operating line for the process can be specified as a functional relationship between: (a) the adiabatic combustion temperature at location 2-11 calculated from the gas temperature at 2-14, the airflow through location 2-9 and the total fuel feed to the process and (b) the temperature at the catalyst inlet, location 2-9.

Each of the functional relationships described above use the gas temperature at the catalyst inlet, location 2-9 in FIG. 2. However, this functional relationship can be specified in terms of the temperature at location 2-7 since the temperature at location 2-9 can be calculated from: (a) the temperature measured at location 2-7 (b) the mass gas flow rate at location 2-7, (c) the fuel flow 2-25 and (d) the temperature measured at location 2-25. Alternatively, when the operation window and operating line is defined by tests run on the gas turbine system, the actual values at the outlet of the flame burner, location 2-7 can be measured.

To those experienced in the art, there would be numerous other ways to express the basic relationship of catalyst inlet gas temperature and catalyst inlet fuel air ratio shown by operating line 5-43, 5-42 and 5-44 in FIG. 5A. It is to be understood that all of these essentially similar relationships are incorporated herein and the present control strategy is not limited to the alternative approaches described herein for expressing the preferred operating line functional relationship.

The gas turbine power output or the exhaust gas temperature downstream of the power extraction turbine is a good indicator of the fuel air ratio at the catalyst. This advantageously allows the definition of an operating line that relates turbine load to catalyst inlet gas temperature or exhaust gas temperature to catalyst inlet gas temperature. This is even more surprising when one considers that the exhaust gas temperature is not in a fixed relationship to the fuel air ratio or adiabatic combustion temperature of the mixture at the catalyst inlet since the temperature drop as the hot gases pass through the drive turbine (1-4 of FIG. 1) is a function of the load, the mass airflow, the efficiency of the turbine and other variables.

Further, the Applicants have found that the exhaust gas temperature delta (EGT delta) may be used to specify operation at a preferred point on an operating line. EGT delta at time t is defined as the calculated exhaust gas temperature at full load at time t ($EGT_{full\ load\text{-}t}$) minus the exhaust gas temperature value at time t ($EGT_t$) and expressed as follows:

$$EGT\ \text{delta}_t = EGT_{full\ load\text{-}t} - EGT_t$$

The exhaust gas temperature at full load ($EGT_{full\ load\text{-}t}$) may be calculated from current operating parameters such as ambient temperature and ambient pressure at any time t and represents the expected exhaust gas temperature when the turbine is running at full load (100% load). The current exhaust gas temperature ($EGT_t$) is the measured value of the exhaust gas temperature at any time t. Subtraction of these values gives the EGT $\text{delta}_t$ at time t.

In accordance with this control system, operating range diagrams such as FIG. 5A are constructed for various turbine operating phases. For example, during the start up of a gas turbine the pressure within the combustion chamber would be near the ambient pressure or pressure at the turbine air intake. A diagram such as that in FIG. 5A is developed for this general operating condition. Similarly, operating diagrams can be generated for other operating phases where the turbine and catalytic combustion process conditions are quite different. This series of diagrams are then used to generate a safe operating regime, called an operating line, for process control to cover the entire operation from start up to full output or full load. This operating line will combine the needs of the process to operate correctly. For example, a gas turbine will have certain power requirements to operate at a given point in its cycle. To start the engine will require some combustion energy and this combustion energy requirement will change with the rotational speed. To operate at idle, that is running at the required turbine rotor speed and producing no power output, will require some level of fuel combustion. In accordance with the present invention, an operating line will preferably be generated based on the engine fuel requirements in each region of turbine operation.

In accordance with the present invention, operating range diagrams can be generated theoretically based on models of the catalyst performance or on actual tests of the catalyst in subscale or full scale test systems. Alternatively, the operating line can be developed by trial and error from engine tests where the operating limits of the catalyst are known generally and the engine fuel schedule is developed by engine testing. This later approach requires some level of data from catalyst performance measurements to define whether the catalyst is within its "safe operating zone".

The result is a control system operating line or schedule on which the control system operates via feed forward and feed back principles to define an allowable catalyst inlet gas temperature and fuel-air ratio region for various points in the gas turbine operation with the controller schedule consisting of allowable gas temperatures for a given fuel-air ratio at the catalyst inlet.

Returning to FIG. 5A, boundaries 5-40 enclose a region 5-41. At any point within region 5-41, it has been found that the catalytic combustor system will give low emissions. Accordingly, system operation within region 5-41 is preferred. It is to be understood, however, that although region 5-41 describes a preferred low emissions operating region, the catalyst and the gas turbine may also be operated in region 5-45, (i.e.: outside of low emissions region 5-41). This may especially be necessary for short periods of time during start up of the gas turbine or at very low load.

In accordance with the present invention, the system is controlled such that operation preferably is carried out within the operating window of region 5-41. It is, however, even more preferred that system operation be carried out at a location along line operating 5-42. In accordance with the present invention, system operation is preferably carried out at points along line 5-42 (i.e.: within region 5-41) or at points along lines 5-43 or 5-44 (i.e.: outside of region 5-41). Operation along the line 5-42 is essentially operation according to a schedule since line 5-42 describes a schedule of pre-determined points relating catalyst inlet gas temperature and catalyst inlet fuel air ratio.

Although operation within the region 5-41 is desired because it provides low emissions, it may not always be possible to operate in this region. For example, during start up of the gas turbine or during low load operation, the turbine may require operation of the catalyst within region 5-45. Operation on lines 5-43 in region 5-45 is defined by the lowest emissions achievable and by other factors such as safe operation of the catalyst for good catalyst durability. Accordingly, operating at points along operating lines 5-43 (being extensions of operating line 5-42) is thus operation at the preferred operating conditions within region 5-45. Together, lines 5-43, 5-42 and 5-44 thus define a preferred operating line (i.e.: preferred system conditions) for the catalyst for the particular gas turbine.

In preferred aspects, the various boundaries of preferred operating window (i.e.: the boundaries between region 5-41 and region 5-45 and the region above line 5-40) may be determined by experimental tests or they can be estimated by semi-empirical models of the catalyst or of the catalytic combustion system being used. Such test results can be used to define the boundaries between high emissions operating region 5-45 and low emissions operating region 5-41 may be based on performance specifications such as desired emissions levels, maximum operating temperatures and other factors.

In accordance with the present invention, the catalytic combustion system is controlled such that it operates within region 5-41, wherein the combustion system will advantageously achieve low emissions with the catalyst exhibiting the necessary durability for industrial application.

It is to be understood that in those instances when the present system is controlled such that it operates at a combination of catalyst inlet gas temperature and fuel air ratio outside of the limits of boundaries 5-40 (i.e. within region 5-45) then some performance specification may not be met (such as operating temperature limit, system durability, emissions etc). This may be necessary during some portions of the operating cycle such as start up, shut down, or during part load operation or emergency operation, it may be necessary to operate the system within region 5-45. It is to be understood that although operation in region 5-45 may not meet emissions requirements or may not meet some other combustor system specification, such operation will not appreciably degrade catalyst durability.

It should be understood that the graph of FIG. 5A illustrates general characteristic functional relationships, and that the specific locations of the lines on the graph (i.e.: boundaries 5-40, and lines 5-42, 5-43 and 5-44) are typically derived from empirical tests or theoretical analysis under defined turbine operating phases of start-up, idle, ramp-up, and operation at various levels of load. Thus, different gas turbine systems with different catalyst designs will have different operating diagrams, but in general the operating diagrams will appear similar to that shown in FIG. 5A. In accordance with the present control system, the combustor/catalyst system is preferably operated at, or near, a preferred set of operating conditions that correspond to a point on operating line 5-42, 5-43 or 5-44.

FIG. 5A shows the operating line as a relationship between the catalyst inlet gas temperature and the fuel air ratio at the catalyst inlet. The catalyst inlet gas temperature can be measured. The fuel air ratio can be either measured, or it can be calculated from other measured parameters or it can be estimated from other parameters of the gas turbine such as turbine speed, the pressure at the exit of the compressor, ambient temperature and pressure and other parameters. Alternatively, the operating diagram and operating line can be constructed to relate catalyst inlet gas temperature and EGT delta as discussed above.

As stated above, it is to be understood that FIG. 5A is merely exemplary of a preferred operating diagram (which defines the relationship between catalyst inlet gas temperature and fuel air ratio). Alternatively, the operating diagram and operating line can also be defined as a relationship between catalyst inlet gas temperature and adiabatic combustion temperature (Tad) at the combustor exit. A third alternative is to define the operating diagram and operating line as the combustor inlet temperature and the split of fuel to each of the sections of the gas turbine since these values can be used to derive the catalyst inlet gas temperature and the fuel air ratio at the catalyst inlet. In another alternative, the operating diagram and operating line can be defined as a relationship between catalyst inlet gas temperature and EGT or EGT delta. In yet another approach, the operating diagram and operating line can be defined as a relationship between the catalyst inlet gas temperature and the turbine inlet temperature or its equivalents. Of course, instead of the catalyst inlet gas temperature (T36), the operating schedule can also be expressed in terms of the temperature at location 2-7 (T34), the temperature at the catalyst exit (T37), or the temperature rise across the catalyst (T37–T36). Those skilled in the art will be able to define any number of other alternative methods to define the operating line and in developing methods to calculate or estimate these values.

In each case, the control system will function to adjust the fuel split within the combustor so that the catalyst inlet gas temperature and catalyst inlet fuel air ratio is at all times on, or as close as possible to, the operating line 5-43, 5-42 and 5-44. This will provide the desired preferred operation.

In those aspects of the invention in which a fuel air ratio versus catalyst inlet gas temperature operating line is used, the fuel air ratio may be determined by monitoring the fuel flow to the fuel injector and the airflow to the combustor. The airflow to the combustor may in turn be determined by measuring the pressure drop across the inlet bell mouth of the compressor, 1-1 in FIG. 1.

In those aspects of the invention in which adiabatic combustion temperature versus catalyst inlet gas temperature operating line is used, adiabatic combustion temperature may be determined by monitoring total fuel flow to the combustor, the total airflow to the combustor and the temperature of the gas entering the combustor. Alternatively, Tad may be determined by monitoring the fuel flow to the injector upstream of the catalyst, the total airflow to the combustor and the temperature of the gas entering the injector. Once again, the airflow to the combustor may in turn be determined by measuring the pressure drop across the inlet bell mouth of the compressor.

The performance of a catalyst or other components of the combustion system or turbine in a catalytic combustion system will change over time. Consequently, an operating diagram (such as shown in FIG. 5A) only corresponds to preferred operating conditions at a particular catalyst state. Stated another way, as a catalyst degrades over time, the schedule of data points defining the preferred operating line (i.e.: the preferred conditions at which the system is operated to minimize emissions) will correspondingly tend to change (i.e.: shift in position on the operating diagram). In addition, the performance characteristics of the catalyst system may also be influenced by the operating conditions of the turbine and by the ambient conditions such as air temperature and pressure.

Figure 4:
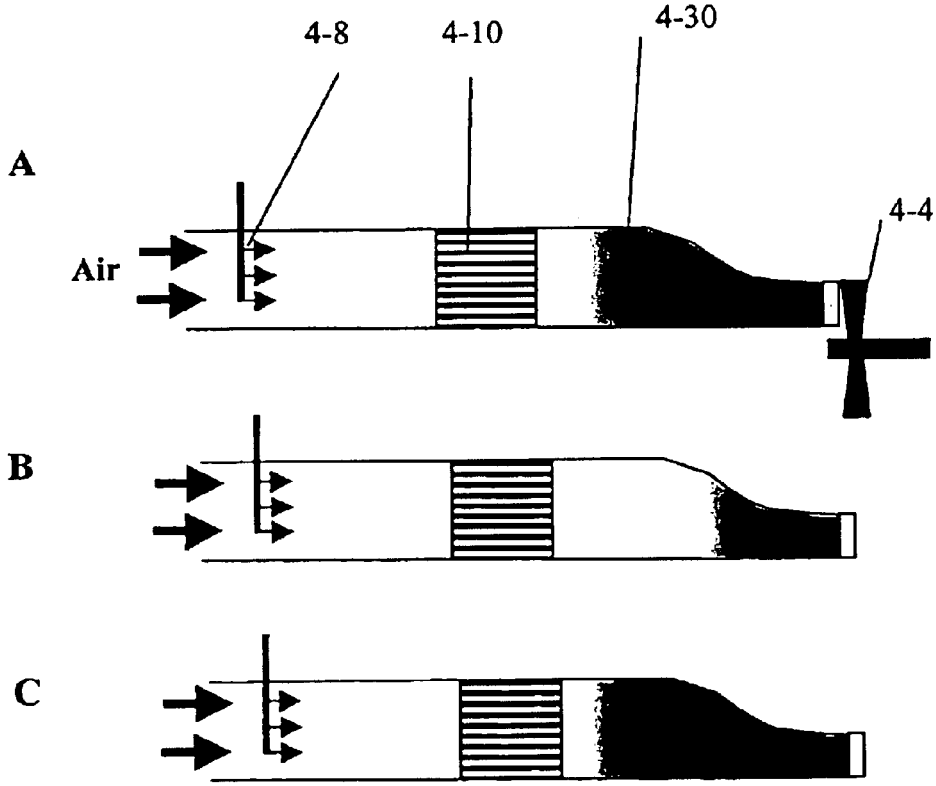
FIG. 4 is a diagram of a catalytic combustion system with varying location of the post catalyst homogeneous wave.

In an optional second aspect of the invention, the present invention provides a novel system for controlling operation of a catalytic combustion system by monitoring the change in the performance of a catalyst over time, and then changing system operation to a new operating line. Specifically, in preferred aspects, the present invention provides a control system which is adapted to correct for a change in the performance of a catalyst by monitoring its change in performance and then shifting system operation to a point on a new operating line to thereby maintain the desired optimum low emissions performance of the catalyst and catalytic combustion system. There are a number of methods to monitor the change in performance. One method involves monitoring the location of the homogeneous combustion process wave. In this method, the operating conditions are periodically adjusted to move the homogeneous combustion wave from position 4-30A to 4-30C as can be seen in FIG. 4. The adjustments can be an increase to the preburner operating temperature, an increase in bypass airflow or an increase to bleed airflow. The specific operating conditions that move the homogeneous combustion wave to 4-30C are recorded and compared to previously recorded operating conditions to determine any change in performance. Other methods to monitor the change in performance can involve monitoring the catalyst exit gas temperature, the temperature rise across the catalyst 3-10 or the fraction of hydrocarbons reacted by the catalyst 3-10.

There are a number of conditions that would cause the operating line to change. For example, the catalyst activity or performance can change due to the aging of the catalyst, deactivation of the catalyst by a contaminant, or other phenomena.

Another condition that would cause the operating line to change is a change in fuel composition. This would change the ignition delay time. For example, a typical natural gas may have an ignition delay time, shown as 3-32 in FIG. 3, in a desired range such that the desired performance, for example, the desired combustor outlet temperature and emissions of the catalyst and combustor system is achieved. However, if the concentration of higher hydrocarbons such as propane or butane increases in the fuel, then the ignition delay time 3-32 will become shorter. This may move the system operation outside of the preferred operating region 5-41 of FIG. 5A. Specifically, the homogeneous reaction process wave may be too close to the catalyst and the catalyst durability may be negatively affected.

Yet another condition that would cause the operating line to change is the aging or wearing of turbine components such that the turbine system specifications change over time. For example, the turbine compressor may become fouled by contaminants in the inlet air causing a decrease in airflow and an increase in compressor discharge temperature. If the fuel air ratio is determined using an estimated airflow from compressor speed and ambient conditions, then the estimated airflow will be incorrect and the apparent operating line will have moved.

While the three effects described above are only examples, they each show that the present system of optionally periodically monitoring the operation of the catalytic combustion system and then altering system operating conditions to a "new" or "revised" operating line is desirable. For example, referring to Table A below, there are three operating lines of EGT delta versus demand temperature at location 2-7, also known as $T_{34}$, for three different levels of activity (1, 2 or 3). The activity, in this example, is catalyst activity that corresponds to the "monitored criteria", in this case the $T_{34}$ required to achieve a specific homogeneous combustion wave location at a given Tad.

TABLE A

| | dEGT vs T34 schedules | | | |
|---|---|---|---|---|
| % Load | dEGT (° C.) | T34 Demand 1 (° C.) | T34 Demand 2 (° C.) | T34 Demand 3 (° C.) |
| 100 | 0 | 500 | 505 | 510 |
| 90 | 35 | 505 | 510 | 515 |
| 80 | 70 | 510 | 515 | 520 |
| 70 | 105 | 520 | 525 | 530 |
| 60 | 140 | 530 | 535 | 540 |
| 50 | 175 | 555 | 560 | 565 |
| 40 | 210 | 580 | 585 | 590 |
| 30 | 245 | 605 | 610 | 615 |
| 20 | 280 | 650 | 650 | 650 |
| 10 | 315 | 650 | 650 | 650 |
| FSNL | 350 | 650 | 650 | 650 |

Control of a Catalytic Combustion System with a Bypass and/or Bleed System

Figure 6:
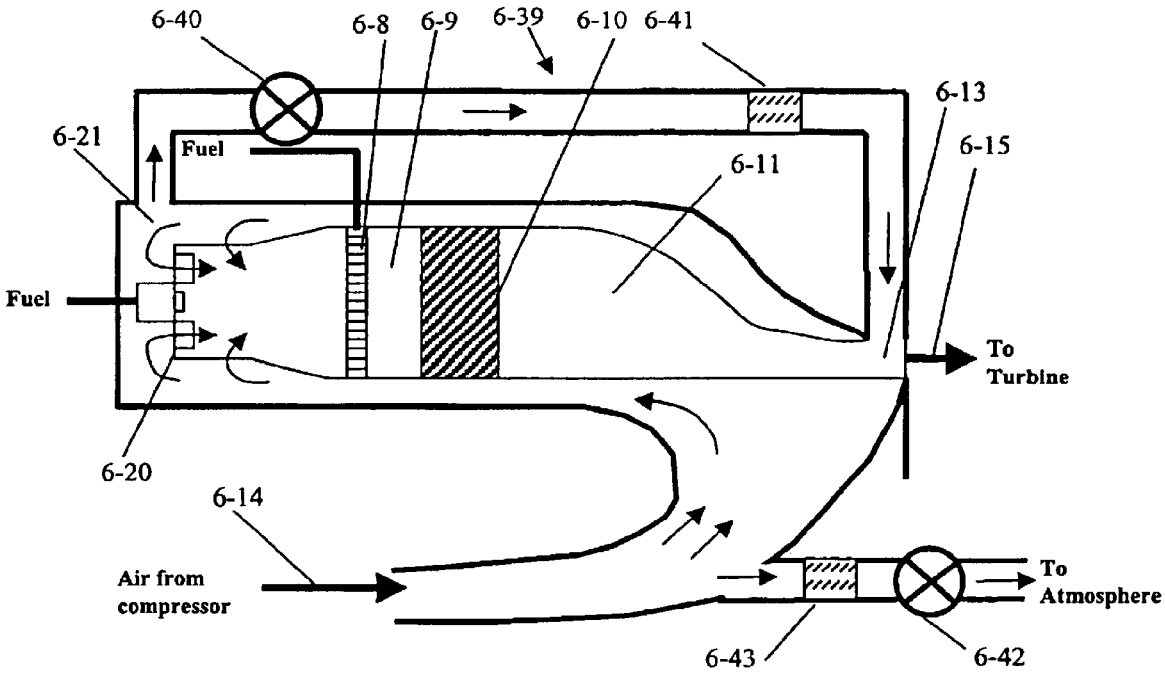
FIG. 6 is a diagram of a catalytic combustion system with a bypass and bleed.
Figure 7:
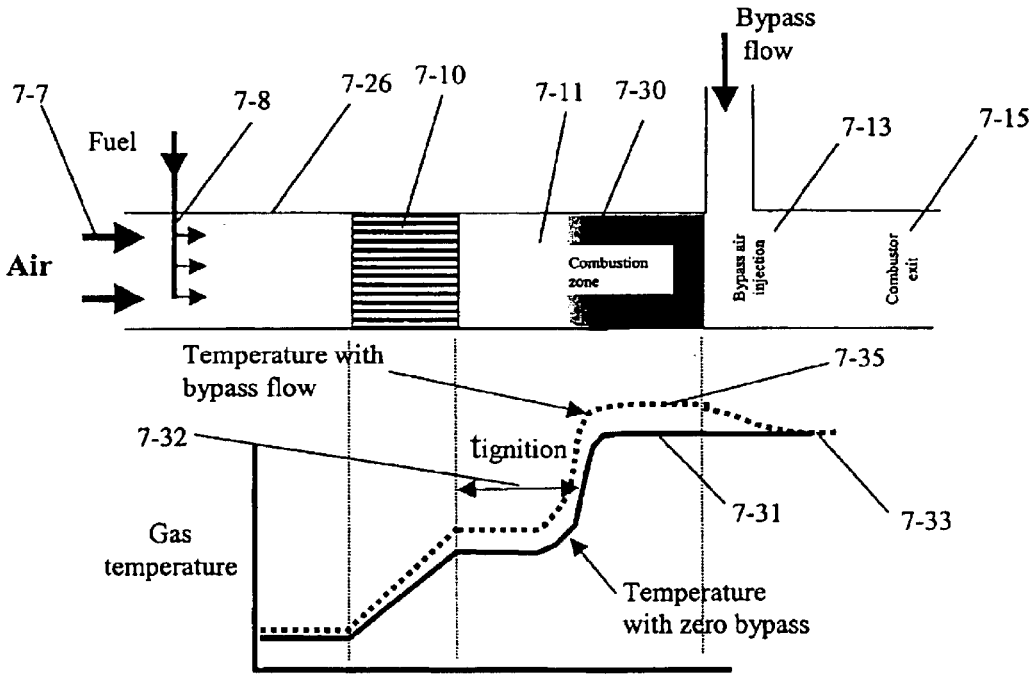
FIG. 7 is a diagram of a catalytic combustion system with a bypass and with associated temperature and fuel concentration profiles.

The control system described above is a basic control system with a fixed operating line or set of operating lines covering the operating modes of the gas turbine. One limitation of the basic system is the fixed relationship between the power output of the engine and the Tad of the combustor. As load is turned down, the engine reduces the total fuel flow to the combustor. As the total fuel flow is decreased, the temperature in the post catalyst reaction zone decreases and it becomes very difficult to fully combust the remaining fuel and in particular the CO and to achieve the desired emissions levels. This limitation is one of many factors that determine the low emissions operating range of the catalytic combustor. A bypass and/or bleed system and the associated control system would eliminate this limitation and can significantly improve the low emissions operating range. A bypass system is shown in FIG. 6. The bypass system 6-39 extracts air from a region near the flame combustor inlet 6-21 and injects the air in a region 6-13 downstream of the post catalyst reaction zone 6-11 but upstream of the power turbine inlet 6-15. Bypass air can also be extracted at the outlet of the compressor, at any location between the compressor outlet and the flame burner or downstream of the flame burner. The bypass airflow can be measured by flow meter 6-41 and controlled by valve 6-40. The bypass flow from region 6-21 to region 6-13 is driven by the pressure difference with region 6-13 at a lower pressure then region 6-21. This pressure difference is due to the pressure drop that occurs through the combustor including the flame burner 6-20, the catalyst fuel injector 6-8 and the catalyst 6-10. The effect of bypass air is illustrated in FIG. 7. Under conditions where there is zero bypass air, the temperature profile within the combustor is shown by solid line where the final combustion temperature 7-31 is equal to the combustor exit temperature 7-33. Under conditions where bypass airflow is non-zero, the temperature profile is represented by the dashed line where the final combustion temperature 7-35 is higher than the case where there is zero bypass airflow. The bypass air is injected at 7-13 which lowers the combustor exit temperature to 7-33, the same combustor exit temperature achieved in the zero bypass airflow case.

The effect of bypass air on emissions can be illustrated by FIGS. 5A and 7. For a given engine load condition with zero bypass airflow, the catalyst inlet temperature and fuel air ratio will be defined by the standard operating line 5-42. Under certain low load conditions and zero bypass airflow, the operating point will be in the high emissions region 5-45 of the operating window. The high emissions could result from either a long ignition delay 7-32 or from a low final combustion temperature 7-31 resulting in high CO emissions. However, at the same low load condition but with bypass airflow, the higher fuel to air ratio in the combustor will decrease the ignition delay time 7-32 and raise the final combustion temperature to 7-35. The higher combustion temperature will also act to oxidize the CO more rapidly. This process can take an operating point in region 5-45 in FIG. 5A and effectively move it to the right and inside the low emission region 5-41. Power output by the engine and engine efficiency remains unchanged because the bypass air is re-injected at 7-13 which maintains the total gas mass flow through the drive turbine and also lowers the combustor exit temperature to the same combustor exit temperature 7-33 achieved in the zero bypass airflow case.

The bleed system is also shown in FIG. 6. The bleed system extracts air from a region near the compressor discharge 6-14 and vents it to the atmosphere. The bleed air can be measured by a flow meter 6-43 and controlled by a valve 6-42. The bleed flow from 6-14 to atmosphere is driven by a pressure difference with 6-14 being higher pressure than atmosphere.

Figure 8:
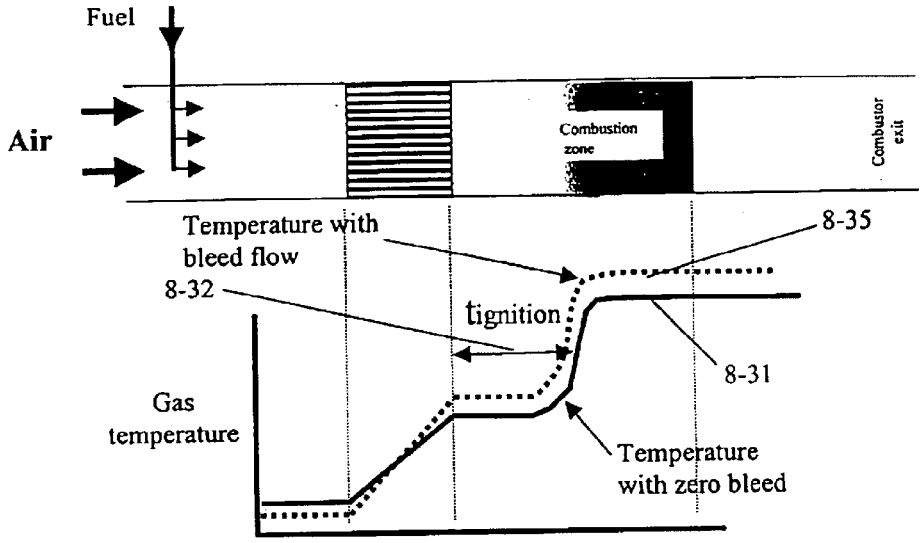
FIG. 8 is a diagram of a catalytic combustion system with associated temperature and fuel concentration profiles and change in profile due to air bleed.

The effect of bleed air is illustrated in FIG. 8. Under conditions where there is zero bleed air, the temperature profile within the combustor is shown by the solid line where the final combustion temperature is 8-31. Under conditions where bleed airflow is non-zero, the temperature profile is represented by the dashed line where the final combustion temperature 8-35 is higher than the case where there is zero bleed airflow. The final combustor outlet temperature is higher because the fuel is combusted in less air and because more fuel must be added to maintain turbine power output with reduced mass flow through the power turbine. The higher combustion temperature compensates for the power loss resulting from the bleed airflow so the net power output by the engine effectively remains unchanged. The effect of bleed air on emissions is the same as the effect of bypass air on emissions.

Many gas turbine systems utilize inlet guide vanes (not shown) in the normal operation of the turbine. Inlet guide vanes are a set of vanes installed at the inlet of the compressor that can be rotated to reduce the airflow into the compressor and therefore the total airflow through the turbine. Inlet guide vanes are used to aid the start up of the turbine. In addition, inlet guide vanes can be used during operation at reduced load to maintain a minimum exhaust gas temperature required by a downstream boiler or other process. In more recent lean premix combustion systems, the inlet guide vanes can be used to reduce airflow and increase fuel air ratio within the combustor to stay within the desired operating range.

The effect of turbine inlet guide vanes on the operation of the catalytic combustion system is essentially the same as in the bleed system shown in FIG. 8. The reduced airflow through the combustor increases the fuel air ratio and results in an increase in the catalyst outlet temperature and in the final combustor outlet temperature.

As load is reduced, the fuel flow to the combustor is decreased and the final combustion temperature downstream of the catalyst decreases and is insufficient to fully combust the remaining fuel and CO. Some range of lower fuel air ratio is within the low emissions window 5-41 as shown in FIG. 5A, when load is reduced so that the operating point moves outside of the low emissions window, then bypassing some of the air around the catalyst will move the operating point to the right and back into region 5-41. It has been found that a preferred control strategy is to adjust the bypass to obtain a final combustion temperature downstream of the catalyst within a preferred operating range. Referring to Table B below, a predetermined schedule relates EGTdelta to the adiabatic combustion temperature in the post catalyst reaction zone, Tad.

TABLE B

| | dEGT vs Tad schedule | | Resulting Bypass Valve |
|---|---|---|---|
| % Load | dEGT (° C.) | Tad Demand (° C.) | Position (%) |
| 100 | 0 | 1300 | 0 |
| 90 | 35 | 1275 | 15 |
| 80 | 70 | 1250 | 30 |
| 70 | 105 | 1225 | 45 |
| 60 | 140 | 1200 | 60 |
| 50 | 175 | 1175 | 75 |
| 40 | 210 | 1150 | 90 |
| 30 | 245 | 1125 | 100 |
| 20 | 280 | 1100 | 100 |
| 10 | 315 | 1075 | 100 |
| FSNL | 350 | 1050 | 100 |

The bypass valve position is used to control this Tad. As load is decreased and $EGT_{delta}$ increases, the bypass is adjusted to maintain the Tad at the value in the schedule by opening the bypass valve. It should be noted that the adiabatic combustion temperature is essentially the same for the gas mixture at the outlet of the catalyst fuel air mixer, 6-8 in FIG. 6, at the inlet of catalyst 6-10 and in the region downstream of the catalyst up to the point where the bypass air is introduced, 6-13. Although the schedule relates $EGT_{delta}$ and Tad, the invention is not so limited and other parameters such as the turbine inlet temperature, EGT, percent full load, compressor discharge pressure, compressor discharge temperature and fuel flow can be employed.

Adiabatic combustion temperature is calculated from the airflow through the combustor and the fuel flow to the combustor and the air temperature. For example, it can be calculated from the temperature of the air entering the combustor, the airflow through the combustor and the total fuel flow to the combustor including the fuel fed to the flame combustor and the catalyst. Alternatively it can be calculated from the temperature at the catalyst inlet, the air flow rate through the catalyst and the fuel flow to the catalyst fuel injector. This latter calculation assumes the fuel fed to the flame burner is fully combusted.

The airflow to the catalyst can be calculated from the total airflow from the compressor multiplied by the fractional airflow that goes to the combustor (some air is used to cool the turbine blades and turbine nozzles as well as adjust the temperature profile at the turbine inlet), and subtracting the airflow through the bypass and bleed. The airflow from the compressor can be calculated from a measurement of the pressure drop at the compressor inlet bell mouth. Alternatively, the airflow through the compressor can be estimated from the turbine rotor speed, the ambient pressure and the ambient temperature. The airflow through the bypass and bleed can be measured by a variety of flow meter systems that are commercially available. For example, a restriction can be placed in the flow path and the inlet pressure, temperature and pressure drop across the restriction measured and the flow calculated. A variety of other flow meter types exist such as vortex shedding meters, and coriolis meters.

Referring to Table C, it has been found that one preferred strategy for controlling the bleed is to set a maximum value for $EGT_{delta}$. As shown in Table C, this $EGT_{delta}$ setpoint is 105° C. for illustrative purposes. The control system acts to open the bleed valve when $EGT_{delta}$ X rises above this value. As load is reduced from full load, $EGT_{delta}$ increases and as it reaches the $EGT_{delta}$ limit value, the control system opens the bleed to maintain the $EGT_{delta}$ at the maximum value. It should be noted that $EGT_{delta}$ is just one parameter of a series of effectively equivalent parameters that can be used. A parameter that can be substituted for $EGT_{delta}$ is % Full Load where % Full Load is defined as the actual load compared to the load that would be obtained if the turbine were operated at full load. Generally the gas turbine has a full load point defined by the manufacturer and usually specified by one or more turbine parameters such as EGT, turbine inlet temperature, compressor discharge pressure, ambient temperature, ambient pressure. It should also be noted that these parameters such as $EGT_{delta}$ and % Full Load can be generated as functions of a set of turbine parameters such as EGT, turbine inlet temperature, compressor discharge pressure, compressor discharge pressure, ambient temperature, ambient pressure. For the purposes of this invention, these alternative methods of specifying the control strategy are essentially equivalent. Of course, the table can be expressed in terms of adiabatic combustion temperature or turbine inlet temperature and a setpoint determined for each.

TABLE C

| Bleed Alone | | | |
|---|---|---|---|
| | Constand dEGT setpoint | | |
| % Load | dEGT Setpoint (° C.) | Resulting Bleed Valve Position (%) | Resulting dEGT (° C.) |
| 100 | 105 | 0 | 0 |
| 90 | 105 | 0 | 35 |
| 80 | 105 | 0 | 70 |
| 70 | 105 | 0 | 105 |
| 60 | 105 | 25 | 105 |
| 50 | 105 | 50 | 105 |
| 40 | 105 | 75 | 105 |
| 30 | 105 | 100 | 105 |
| 20 | 105 | 100 | 140 |
| 10 | 105 | 100 | 175 |
| FSNL | 105 | 100 | 210 |

Figure 9:
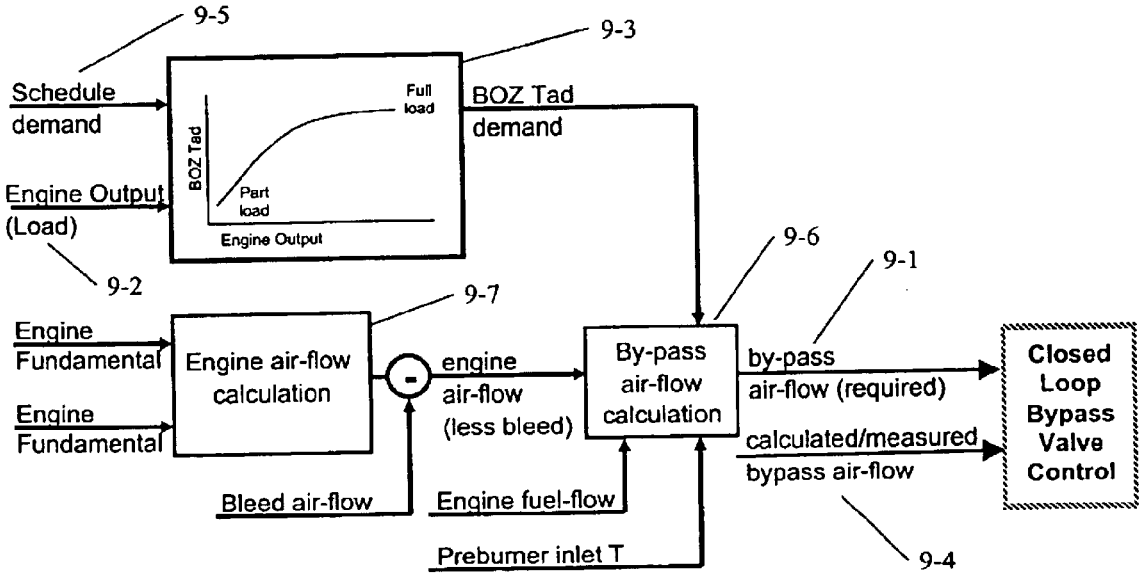
FIG. 9 is a schematic diagram of functional elements for the control of the bypass.

The bypass control system has several key functional groups as illustrated in FIG. 9. First, it determines the required bypass flow of air 9-1 to be extracted from the preburner inlet 6-21 as a function of engine output power (load) 9-2. The required bypass flow is determined from a schedule 9-3 that is provided by a controller at input 9-5 and selected based on any number of operating conditions and parameters. The schedule 9-3 reflects the adiabatic combustion temperature (Tad) corresponding to the final combustion temperature 7-35 in the post catalyst reaction zone 6-11 versus engine load. The engine load can be simply the power output in kilowatts but can also be determined from the combination of fundamental engine performance measurements such as exhaust gas temperature, turbine inlet temperature, ambient temperature, ambient pressure, compressor discharge pressure and/or compressor discharge temperature. The schedule 9-3 can employ these parameters. The value for Tad that is selected from schedule 9-3 given the input of engine load is used to calculate the bypass airflow demand at block 9-6. This calculation also includes the total fuel flow to the engine, the temperature at the preburner inlet, and the airflow entering the engine minus any bleed airflow. The engine airflow calculation is performed at block 9-7 by using fundamental engine parameters and measurements that are selected such that they remain substantially accurate throughout the entire operating range of the engine. These measurements, for example, can include the ambient temperature and the pressure at the compressor bellmouth.

Next, the bypass control system determines the bypass airflow prior to re-injecting the extracted air into the region 6-13 downstream the post catalyst reaction zone 6-11. This measurement (9-4) can be from any type of low pressure drop flow measuring device 6-41. However, the bypass flow 9-4 can be calculated from key measurements of the bypass airflow temperature, the pressure drop across the bypass valve 6-40 and effective area (Acd) of the bypass valve 6-40.

Finally, the bypass control system operates the bypass valve 6-40 to attain the desired extraction flow rate. The bypass valve is closed loop controlled, based on the required versus the actual bypass airflow that is measured or calculated. Alternatively, the valve airflow is calibrated to valve position and some measured parameter such as pressure, temperature and pressure drop. In which case, the control system sets the valve position. In the former case, an accurate and rapid determination of bypass airflow measurement is required to ensure optimum combustor performance. In the latter case, the flow characteristics or flow calibration of the valve is required.

The bleed control system operates the bleed valve to attain a desired exhaust gas temperature ($EGT_{bleed\ setpoint}$). Alternatively, the bleed control system operates the bleed valve to attain a desired difference ($dEGT_{bleed\ setpoint}$) from the exhaust gas temperature limit that determines full load (expressed as $EGT_{full\ load}$ or $EGT_{limit}$). $dEGT_{bleed\ setpoint}$ is expressed as follows:

$$dEGT_{bleed\ setpoint}=EGT_{full\ load}-EGT_{offset}$$

$EGT_{offset}$ is selected from a predetermined schedule. The bleed valve is closed loop controlled, based on required versus measured exhaust gas temperature or required versus EGT delta. Of course, the bleed control system can also be expressed in terms of a desired adiabatic combustion temperature, turbine inlet temperature, fuel-to-air ratio, catalyst temperature, catalyst inlet temperature among other parameters. The resulting bleed airflow is measured for proper control of the bypass system and the preburner's primary fuel flow.

Control of the flame combustor upstream of the catalyst may be impacted by the bypass or bleed operation. For example, if the control of the flame combustor is a function of the airflow through the flame combustor or of the total airflow through some portion of the combustor, then this airflow must be corrected for the flow of bypassed air or the flow of bleed air.

A more detailed description of the strategies and algorithms for measuring the bleed flow, operating the bleed valve, determining the required bypass flow, measuring the bypass flow, operating the bypass valve is described below and illustrated in FIG. 10.

Measuring the Bleed Airflow

The control strategy and algorithm for measuring the bleed airflow will now be discussed in more detail with reference to FIG. 10. Focusing on 10-1, there is depicted function block F18 that outputs the bleed airflow ($W_{a,\ bleed}$). The bleed airflow can be measured directly using a flow-measuring device 6-43 such as an orifice flow meter. Alternatively, the bleed airflow can be calculated from fundamental measurements such as absolute pressure, pressure drop, temperature and effective area. Either way, the bleed airflow is determined by function characterization F18 in FIG. 10 at 10-1. One example of how, bleed airflow can be calculated with an orifice plate will now be discussed. The inputs are as follows:

$P_L$=pressure upstream of the orifice plate in psia $T_L$=temperature upstream of the orifice plate in ° F.

$dP_{orf}$=differential pressure in inches of water (must converted from 0 to 10 psia transducer)

The calculations are as follows:

$$SCFM = \frac{5.9815\times(d^2)\times(K)\times(Y)\times\sqrt{dP_{orf}}\times\sqrt{\frac{(2.703\times P_L\times SG)}{(460+T_L)}}}{\frac{(2.703\times 14.7\times SG)}{(460+T_b)}}$$

where, for example:

d=orifice bore in inches 1.55

K=flow coefficient=$C/\sqrt{(1-\beta^4)}$ $C=0.5959+0.0312\ \beta^{2.1}-0.184\ \beta^8+91.71\ \beta^{2.5}\ R_n^{-0.75}$ Y=expansion factor=$1-[(0.41+35\times\beta^4)\times(dP_{orf}\times 0.361)(P_L\times 1.4)]$ $T_b$=base temperature in ° F=60

β=beta ratio (bore to pipe ID)=1.55/2.067=0.7499

SG=specific gravity=1.00 for air

SH=specific heat ratio Cp/Cv=1.4 for air $R_n$=reynolds number at max flow=532,634.0841

Substituting the values and constants into the equation results in the following:

$$SCFM=188.0705\times(K)\times(Y)\times\sqrt{dP_{orf}}\times\sqrt{(2.703\times P_{L)/(460+T_{L)}}}$$

$$SCFM=309.203\times(K)\times(Y)\times\sqrt{dP_{orf}}\times\sqrt{(P_{L)/(460+T_{L)}}}$$

Operating the Bleed Value

Figure 10:
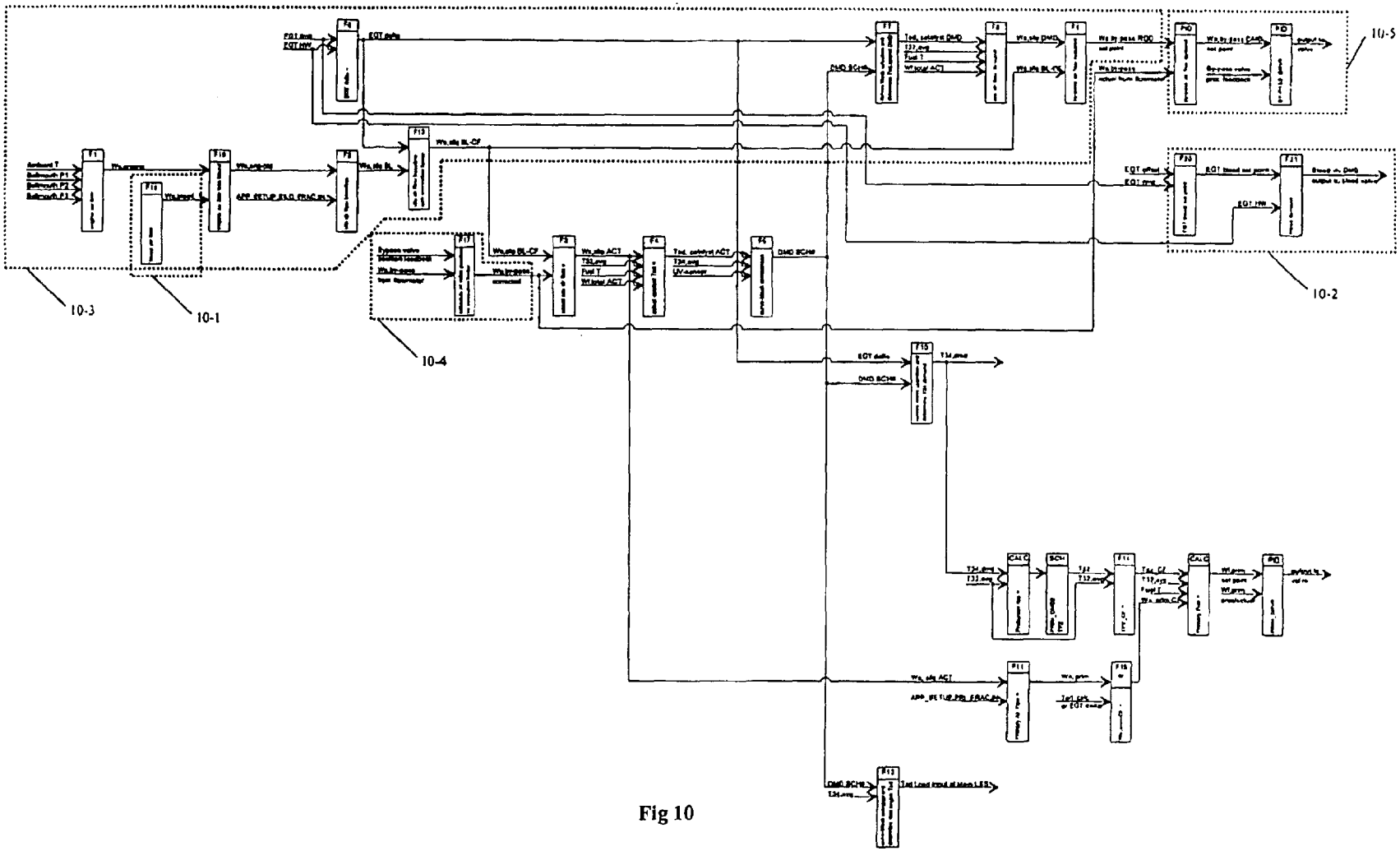
FIG. 10 is a schematic diagram of functional elements for the control of the bleed and bypass.

Referring now to 10-2 of FIG. 10, there is shown a portion 10-2 of the control system that illustrates bleed valve operation. The bleed air valve is preferably closed loop controlled on a specific or combination of engine fundamental parameters such as exhaust gas temperature, turbine inlet temperature, compressor discharge pressure, compressor discharge temperature or fuel flow. The bleed valve operation illustrated by 10-2 is described by functional characterizations F20 and F21. In the example illustrated by 10-2, the resulting output is a demand signal fed to the bleed valve. A valve feed back process signal is not required but could be implemented. As indicated above, the bleed control system operates the bleed valve to attain a desired exhaust gas temperature ($EGT_{bleed\ setpoint}$) or a $dEGT_{bleed\ setpoint}$ defined as the difference between EGT limit ($EGT_{limit}$) and a predetermined $EGT_{offset}$ that is based on a predetermined operation specific demand schedule as a function of catalyst activity schedule number determined in function block F5 in FIG. 10.

The inputs at function block F20 are values for $EGT_{offset}$ and $EGT_{limit}$. The $EGT_{offset}$ is preselected from a schedule based on an activity schedule number such as the example illustrated below:

| Activity Schedule No. | $EGT_{offset}$ (° F.) |
|---|---|
| 1 | 175 |
| 2 | 170 |
| 3 | 165 |
| 4 | 160 |
| 5 | 155 |
| 6 | 150 |
| 7 | 145 |
| 8 | 140 |
| 9 | 135 |
| 10 | 130 |
| 11 | 125 |

The values for $EGT_{limit}$ and $EGT_{offset}$ are used to calculate the $EGT_{bleed\ setpoint}$ as follows:

$$EGT_{bleed\ setpoint}=(EGT_{limit})-(EGT_{offset})$$

The value for $EGT_{bleed\ setpoint}$ is input to function block F21 and compared to the value for EGT measured via the hardwired harness $EGT_{hw}$. A bleed valve demand signal is the generated output of F21 via closed loop control, preferably proportional, integral and derivative (PID) control of the bleed valve based on an $EGT_{bleed\ setpoint}$ from F20 and feedback from the EGT hardwired harness ($EGT_{hw}$). The bleed valve should open to raise $EGT_{hw}$ until $EGT_{bleed\ setpoint}$ is achieved. When $EGT_{bleed\ setpoint}$ is exceeded, the bleed valve should close.

Determining the Required Bypass Airflow

Still referencing FIG. 10, the algorithms used to determine the required bypass airflow are illustrated by 10-3 and described in detail by functional characterizations F1, F2, F6, F7, F8, F9, F13, F18, and F19. Functional block F9 defines the required bypass airflow as the difference between the baseline and demand silo airflows. F6, F7 and F8 determine the demand silo airflow calculated from the adiabatic combustion temperature requirement in the post catalyst reaction zone 6-11 versus engine load. F1, F2, F13, F18, and F19 calculate the baseline silo airflow through a series of air mass balance calculations.

First, with respect to the demand silo airflow ($W_{a,silo\ DMD}$), $EGT_{limit}$ and EGT determine by the hardwired harness $EGT_{hw}$ are provided at F6 and $EGT_{delta}$ is calculated there from as follows:

$$EGT_{delta}=(EGT_{limit})-(EGT_{hw})$$

$EGT_{delta}$ is then fed into block F7 together with the demand schedule number (DMD SCH#) based on activity measurements of the system. Activity measurements may be taken daily or at any other frequency. The DMD SCH# corresponds to a predetermined $EGT_{delta}$ schedule from which a predetermined catalyst adiabatic combustion temperature demand ($T_{ad,catalyst\ DMD}$) is selected. The schedule for the catalyst adiabatic combustion temperature demand will change every time the demand schedule number (DMD SCH#) changes as required by the adaptive controls. An example of a typical schedule corresponding to a particular DMD SCH# is shown below. If, for example, the $EGT_{delta}$ is 229° F., then F7 will output a $T_{ad,catalyst\ DMD}$ value of 1154° C.

| $EGT_{delta}$ ° F. | $T_{ad,catalyst}$ DMD ° C. |
|---|---|
| 0 | 1292 |
| 1 | 1292 |
| 63 | 1291 |
| 122 | 1245 |
| 178 | 1201 |
| 229 | 1154 |
| 277 | 1115 |
| 320 | 1110 |
| 380 | 1083 |
| 425 | 1083 |
| 440 | 1083 |
| 460 | 980 |
| 500 | 980 |
| 550 | 730 |

To calculate the silo airflow demand ($W_{a,silo\ DMD}$), the $T_{ad,catalyst\ DMD}$ from F7 is fed to F8 along with the average preburner inlet temperature ($T32_{avg}$), the actual total fuel flow measured by flowmeter ($W_{f,total\ ACT}$), the natural gas temperature from the resistance temperature detector (RTD) at the fuel skid (Fuel T). The silo airflow demand ($W_{a,silo\ DMD}$) is calculated as follows:

$$(W_{a,silo\ DMD})=(W_{f,total\ ACT})/(\text{mass } F/A)$$

Mass F/A is defined by an analytical expressions relating adiabatic combustion temperature and fuel/air ratio. F9 determines the required bypass airflow ($W_{a,bypass\ RQD}$) by taking the difference between the baseline ($W_{a,silo\ BL\text{-}CF}$) and demand silo ($W_{a,silo\ DMD}$) airflows.

The baseline ($W_{a,silo\ BL\text{-}CF}$) silo airflow is provided by illustrative functional characterizations F1, F2, F13, F18 and F19. Referring first to block F1, the ambient temperature, bellmouth pressure 1, bellmouth pressure 2, and bellmouth pressure 3 are inputs from which is calculated the engine airflow ($W_{a,engine}$) based on fundamental measurements on the engine that are accurate throughout the entire operating range of the engine. In this example, the engine airflow is calculated based on ambient temperature and pressure in the compressor's bellmouth as follows:

$$W_{a,engine}=A^*(DP)+B^*T_{amb}$$

where A and B are constants, DP is the average of the 3 bellmouth pressures and $T_{amb}$ is the ambient temperature. Next, the bleed airflow ($W_{bleed}$) is provided at block F18 where the pressure upstream of the orifice plate in psia ($P_L$), the temperature upstream of the orifice plate in ° F ($T_L$), the differential pressure in inches of water converted from a 0 to 10 psia transducer ($dP_{orf}$) are inputs and the calculations are as follows:

$$SCFM=\frac{5.9815\times(d^2)\times(K)\times(Y)\times\sqrt{dP_{orf}}\times\sqrt{\frac{(2.703\times P_L\times SG)}{(460+T_L)}}}{\frac{(2.703\times 14.7\times SG)}{(460+T_b)}}$$

where d=orifice bore in inches 1.55

K=flow coefficient=$C/\sqrt{(1-\beta^4)}$

C=0.5959+0.0312 $\beta^{2.1}$−0.184 $\beta^8$+91.71 $\beta^{2.5}$ $R_n^{-0.75}$

Y=expansion factor=1−[(0.41+35×$\beta^4$)×($dP_{orf}$×0.361)($P_L$×1.4)]

$T_b$=base temperature in ° F=60

β=beta ratio (bore to pipe ID)=1.55/2.067=0.7499

SG=specific gravity=1.00 for air

SH=specific heat ratio Cp/Cv=1.4 for air $R_n$=reynolds number at max flow=532,634.0841

Substituting the values and constants into the equation results in the following:

$$SCFM=188.0705\times(K)\times(Y)\times\sqrt{dP_{orf}}\times\sqrt{(2.703\times P_{L)/(460+T_{L)}}}$$

$$SCFM=309.203\times(K)\times(Y)\times\sqrt{dP_{orf}}\times\sqrt{(P_{L)/(460+T_{L)}}}$$

The engine airflow minus the bleed airflow ($W_{a,\ eng\text{-}bld}$) is calculated at F19 by subtracting the bleed airflow obtained from the engine airflow ($W_{a,engine}$) as follows:

$$W_{a,eng\text{-}bld}=(W_{a,engine})-(W_{a,bleed})$$

At function block F2, the silo airflow baseline ($W_{a,silo\ BL}$) is determined. The silo airflow baseline is typically a fixed fraction of the available engine airflow. The engine airflow less bleed ($W_{a,eng\text{-}bld}$) from F19 and the silo air fraction constant (APP_SETUP.SILO_FRAC.IN) are inputted and the silo airflow baseline is calculated as follows:

$$W_{a,silo\ BL}=(APP_SETUP.SILO_FRAC.IN)^*(W_{a,eng\text{-}bld})$$

Still referencing 10-3 of FIG. 10, the silo airflow baseline with correction factor ($W_{a,silo\ BL\text{-}CF}$) is provided at F13. The correction factor can be used to address those engine and combustor designs where the silo airflow is not a fixed fraction of the available engine airflow as a function of load. The correction faction should be a function of fundamental engine performance measurements such as exhaust gas temperature, combustor pressure drop, ambient temperature, ambient pressure, compressor discharge pressure and/or compressor discharge temperature. In this example, the correction factor is a function of the exhaust gas temperature (EGT). As can be seen in FIG. 10 at 10-3, the inputs to F13 are the silo airflow baseline ($W_{a,silo\ BL}$), the difference between actual EGT and EGT limit ($EGT_{delta}$) from function F6, and a correction factor (CF) where:

$$CF=1/(1-y) \text{ and where}$$

$$y=A^*EGT_{delta}+B$$

The $W_{a,silo\ BL\text{-}CF}$ is calculated as follows:

$$W_{a,silo\ BL\text{-}CF}=W_{a,silo\ BL}{}^*CF$$

Alternatively, the silo airflow baseline can be calculated in a variety of other ways. For example, the silo airflow baseline can be calculated based upon the compressor discharge temperature, compressor discharge pressure and the differential pressure between the compressor discharge pressure and preburner inlet.

In another alternative, the silo airflow baseline can be calculated based upon the compressor speed and the ambient temperature and ambient pressure of the silo wherein the silo airflow baseline is a function of these parameters in addition to various constants and the normalized plant load output including any correction or bleed airflow if applicable. In this alternative, the output silo airflow baseline is only an estimate based upon given compressor efficiencies and operating parameters. As the gas turbine engine ages, its efficiency may differ from its actual operating efficiency such that the silo airflow baseline of this alternative differs slightly from the actual silo airflow. Other alternatives are also possible. For example, the silo airflow baseline can be calculated from a mass and heat balance based on total fuel flow and exhaust gas temperature measurements. The accuracy of the calculation can be improved by including losses for radiation, pressure losses in the inlet and exhaust duct, degradation of engine performance (compressor and turbine efficiencies), bleed air, and compressor inlet guide vanes among other losses. The silo airflow baseline can also be calculated from a mass balance based on exhaust gas emissions (specifically, $CO_2$, $O_2$, and $H_2O$), total fuel flow and engine operating efficiencies. In yet another alternative, the silo airflow baseline can be calculated from a heat and mass balance across the preburner or fuel/air mixer.

Measuring the Bypass Airflow

Referring now to 10-4 of FIG. 10, the total bypass airflow can be measured using a flow measuring device or calculated from key measurements of the bypass airflow temperature, the pressure drop across the bypass valve 6-40 and the effective area (Acd) of the bypass valve 6-40. The total bypass airflow comes from both the silo and engine cooling air. Since this portion of the control algorithm is concerned with the air management within the silo, the bypass airflow from the silo needs to be separated from the total bypass airflow measured. The fraction of total bypass air from the silo is a function of pressure drop across the bypass pipe and compressor discharge pressure. In the event this pressure drop measurement is not available, alternative measurements can be used. In this example, functional characterization F17, a schedule versus bypass valve position was employed. F17 outputs a bypass airflow with correction factor ($W_{a,bypass\text{-}CF}$) given the inputs of bypass valve feedback position and the bypass airflow from the flow meter measurement ($W_{a,by\text{-}pass\ ACT}$). The calculation at F17 is as follows:

$$W_{a,bypass\text{-}CF}=W_{a,\ bypass\ ACT}*CF$$

CF is a predetermined correction factor based on the bypass valve position and selected from a table such as:

| Valve position | CF |
|---|---|
| 0 | 1 |
| 25 | 0.95 |
| 50 | 0.90 |
| 75 | 0.89 |
| 100 | 0.88 |

The bypass airflow with correction factor ($W_{a,bypass\text{-}CF}$) is fed to F3 together with the silo airflow baseline with correction factor ($W_{a,silo\ BL\text{-}CF}$) to determine the actual silo airflow ($W_{a,silo\ ACT}$) by the following calculation:

$$(W_{a,silo\ ACT})=(W_{a,silo\ BL\text{-}CF})-(W_{a,bypass\text{-}CF})$$

The actual silo airflow is fed to F11 to determine the airflow to the primary preburner ($W_{a,prim}$). The airflow to the primary preburner ($W_{a,prim}$) is corrected at F15 and fed to control block F30 to calculate the primary preburner fuel flow set point ($W_{f,prim\ setpoint}$). The primary fuel flow set point is calculated as a function of the primary preburner airflow, the preburner inlet temperature (T32), and the demand preburner exit temperature ($T34_{dmd}$). The demand preburner exit temperature is obtained at F10 wherein the demand schedule number (DMD SCH#) and $EGT_{delta}$ are inputs. At F10, the demand schedule number provides a predetermined schedule relating $EGT_{delta}$ to the demand preburner exit temperature ($T34_{dmd}$) which is selected based on the $EGT_{delta}$ value. The primary fuel flow set point is compared to the actual primary fuel flow and the closed-loop PID control module provides an output to the primary preburner fuel valve accordingly.

In an embodiment that includes a secondary preburner, the value for $T34_{dmd}$ obtained at F10 is used to calculate the secondary preburner fuel flow wherein the secondary preburner fuel flow is also a function of the preburner inlet temperature (T32) and the secondary preburner airflow ($W_{a\ sec}$). The secondary preburner airflow is obtained by calculating the difference between the primary preburner airflow and the total silo airflow. Alternatively, the total preburner fuel flow can be calculated as a function of the total silo airflow, the preburner inlet temperature (T32), and the preburner outlet temperature demand ($T34_{dmd}$). The actual preburner outlet temperature ($T34_{act}$) feedback is used in closed loop control to trim the fuel flow to the secondary preburner.

Operating the Bypass Value

Referencing 10-5 of FIG. 10, bypass valve operation will now be discussed. The bypass valve should be closed loop controlled on bypass flow by comparing the required bypass airflow (10-3) to the measured bypass airflow (10-4). The closed loop control on bypass flow results in a demand signal to the valve. In the example illustrated in 10-5, the bypass valve has a position feedback feature to ensure the required valve position is attained and controlled.

Control of a Catalytic Combustion System—Prior Art

The basic control strategy for a catalytic combustion system is illustrated in FIG. 11. The output 11-1 of the low signal select bus (LSS) is equivalent to a total fuel flow requirement of the gas turbine engine. The total fuel flow requirement is fed to a catalyst adiabatic combustion temperature calculation 11-2 which is a function of total fuel flow, preburner inlet temperature 11-3 and silo air mass flow 11-4. In this illustration, the silo air mass flow is a function of engine fundamental measurements of bell mouth pressure 11-5 and ambient temperature 11-6. However, the invention is not so limited and other engine fundamental measurements can be employed as discussed above. The catalyst adiabatic combustion temperature 11-7 is fed into the catalyst operating line schedule which specifies the preburner operating temperature demand $T34_{dmd}$ 11-9 for any given catalyst adiabatic combustion temperature. The preburner operating temperature demand 11-9 is fed to the preburner primary zone temperature control 11-10 and the preburner secondary zone temperature control 11-11.

The preburner primary zone temperature control 11-10 is a function of primary zone airflow, preburner inlet temperature T32 11-3 and preburner operating temperature demand $T34_{dmd}$ 11-9. For any given temperature rise across the preburner, defined as the difference between 11-9 and 11-3, there is a primary zone temperature demand. The primary zone temperature demand is translated into a primary fuel valve flow demand 11-12 using an adiabatic combustion temperature calculation.

The preburner secondary zone temperature control 11-11 is a function of secondary zone airflow, preburner inlet temperature 11-3 and preburner operating temperature demand 11-9. An adiabatic combustion temperature calculation is used to translate the preburner temperature demand 11-9 to a total preburner fuel flow demand. The primary fuel valve flow demand 11-12 is subtracted from the total preburner fuel flow demand, which leaves the secondary fuel valve flow demand 11-13. The preburner exit temperature 11-14 is fed back to the preburner secondary zone temperature control 11-11 so that the control system can increase or decrease the secondary fuel valve flow demand as needed to perform closed loop control on temperature.

The total fuel flow requirement of the gas turbine engine (output 11-1 of the LSS) is also fed to the catalyst fuel flow control 11-15. Actual fuel flow from the primary fuel valve 11-16 and secondary fuel valve 11-17 are subtracted from the total fuel flow requirement 11-1. The remaining fuel flow is the demand 11-18 to the catalyst fuel valve.

Control of a Catalytic Combustion System

This control method of the present invention is illustrated in FIG. 12. The method for determining the preburner operating temperature demand 12-9 is not a function of catalyst adiabatic combustion temperature 11-7. Instead, the control system utilizes the inherent relationship between the catalyst adiabatic combustion temperature and the difference ($EGT_{delta}$) between exhaust gas temperature limit ($EGT_{limit}$) that defines full load and the exhaust gas temperature (EGT). The preburner operating temperature demand 12-9 can now be a function of the difference between EGT limit 12-7A and EGT 12-7B. Alternatively, the control system can employ the inherent relationship between the catalyst adiabatic combustion temperature and the exhaust gas temperature.

In other embodiments, the control system utilizes the inherent relationship between the catalyst adiabatic combustion temperature and the turbine inlet temperature, between the adiabatic combustion temperature and the fuel-to-air ratio; between the adiabatic combustion temperature and the intermediate or interstage temperature measurement between the turbine and rotor in a two-stage assembly; between the adiabatic combustion temperature and the load or power output of the turbine.

Control of a Catalytic Combustion System with Bypass and Bleed Valves

FIG. 13 illustrates where the bypass 13-1 and bleed 13-2 control logic interfaces with the control logic of FIG. 12. Feed back from the bleed airflow rate from the flow meter 13-3 now impacts the silo air mass flow rate calculation 13-4. Details on the bypass and bleed control logic are shown in FIGS. 14 and 15 respectively.

The bypass logic controls the catalyst adiabatic combustion temperature by comparing catalyst adiabatic combustion temperature output 14-8 to the catalyst adiabatic combustion temperature schedule demand 14-9 in the bypass airflow control block 14-10. The catalyst adiabatic combustion temperature calculation 14-1 is a function of silo air mass flow rate 14-2, preburner inlet temperature 14-3, actual fuel flow from the primary 14-4, secondary 14-5 and catalyst 14-6 fuel valves, and bypass airflow from the flow meter 14-7. The catalyst adiabatic combustion temperature schedule demand 14-9 is a function of catalyst activity 14-11 and the difference between exhaust gas temperature limit ($EGT_{limit}$) that defines full load 14-12 and the exhaust gas temperature (EGT) 14-13. Alternatively, the catalyst demand schedule 14-9 is a function of catalyst activity and the turbine inlet temperature, the fuel-to-air ratio, the intermediate or interstage temperature measurement, or the load or power output of the turbine.

By comparing the catalyst adiabatic combustion temperature output 14-8 to the demand 14-9, the bypass airflow control block 14-10 determines the bypass airflow rate demand 14-14 to operate the bypass valve. The actual bypass airflow rate from the flow meter 14-7 is fed back into the bypass airflow control block 14-10 to perform closed loop control on bypass airflow.

Referring now to FIG. 15, the bleed valve control 15-1 is a function of an exhaust gas temperature difference set point ($dEGT_{setpoint}$) 15-2 and the difference between exhaust gas temperature limit ($EGT_{limit}$) that defines full load 15-3 and the exhaust gas temperature (EGT) 15-4. The $dEGT_{setpoint}$ 15-2 is determined from a schedule 15-5 based on catalyst activity 15-6. The bleed valve control demand 15-7 increases and decreases as needed to perform closed loop control on dEGT. Alternatively, the bleed valve control 15-1 is a function of the turbine inlet temperature, the fuel-to-air ratio, or the interstage temperature.

Hence, control strategy has been developed to allow the gas turbine to operate at lower load or at other conditions where the total fuel required by the gas turbine is not optimum for full combustion of the fuel. The additional control strategy manages air that bypasses the catalytic combustor and air that bleeds off of the compressor discharge. The bypass system changes the fuel air ratio of the catalytic combustor without affecting the overall gas turbine power output. The bleed system also changes the fuel air ratio of the catalytic combustor but at the cost of reducing the overall gas turbine efficiency. The key advantage of a catalytic combustor with a bypass and bleed system and the inventive control strategy is that it can maintain the catalyst at optimum low emissions operating conditions over a wider load range than a catalytic combustor without such a system.

As described herein, the present additional control strategy has been developed to allow the gas turbine to smoothly transition from full combustion of the fuel in the post catalyst reaction zone to minimal combustion in the reaction zone. The additional control strategy minimizes the air that bypasses the catalytic combustor, increases the temperature of the mixture upstream of the catalyst and operates the total fuel required by the gas turbine on an open-loop control (non-feedback) basis.

While unloading the gas turbine at a fixed ramp rate, the loss of the homogeneous combustion process wave in the post catalyst reaction zone rapidly and significantly reduces the shaft output power. The control system responds in such a manner that the homogeneous combustion process wave is re-established which increases shaft output power above the set point. With the feedback power greater than the set point, the control system responds such that the homogeneous combustion process wave is lost resulting in shaft output power less that the set point. This cycle of re-establishing and losing the homogeneous combustion process wave repeats several times until the fuel-to-air ratio in the post catalyst reaction zone is sufficiently low such that the homogeneous combustion process wave cannot re-establish itself. The problem is illustrated in FIG. 16.

This invention provides an improved method of controlling the engine unloading sequence to eliminate the repeated cycles of re-establishing and losing the homogeneous combustion process wave and subsequent cycles in shaft output power. The improved method involves reducing the bypass airflow and increasing the catalyst inlet temperature (preburner outlet temperature) while holding constant or ramping the total fuel flow requirement of the engine on an open loop control (non-feed back control) basis.

The improved control method is activated by detecting the loss of the homogeneous combustion process wave. The primary method of detecting the loss of the homogeneous combustion process wave is through the rate of change of shaft output power. However, other detection methods such as a temperature measurement device or flame sensor device in the post catalyst reaction zone or temperature of the engine exhaust gas could also be utilized. Once activated, the improved control method will ramp down the bypass air flow to reduce the fuel-to-air ratio and increase the average velocity in the post catalyst reaction zone which minimizes the likelihood of re-establishing the homogeneous combustion process wave within the allowable residence time. One method of reducing the bypass airflow rate is to set the airflow rate demand to the bypass valve (14-14) to zero. Alternatively, the bypass valve position can be set to zero.

Additionally, the control method will ramp up the catalyst inlet temperature (preburner outlet temperature) to increase the catalyst exit temperature which minimizes the magnitude of the loss in output power resulting from the loss of the homogeneous combustion process wave in the post catalyst reaction zone. This could be done by setting the preburner temperature set point 13-4 to a value of 650 C for example.

Furthermore, the control system will hold constant or ramp the total fuel flow requirement of the engine via open loop control which will eliminate the repeated feedback cycles of re-establishing and losing the homogeneous combustion process wave and subsequent cycles in output power. This can be done by holding constant or ramping the value of the LSS output 13-5. The value at which 13-5 is held constant at a value high enough to ensure shaft output is sufficient for the engine to stay synchronized to the grid and continue exporting power yet low enough to ensure homogeneous combustion does not re-establish. In the case where the total fuel flow requirement is ramped up, the limits for the ramp should be bracketed by values such that shaft output is sufficient for the engine to stay synchronized to the grid and homogeneous combustion does not re-establish.

Also, the control system will decrease the bleed air flow to reduce the fuel-to-air ratio and increase the average velocity in the post catalyst reaction zone which minimizes the likelihood of re-establishing the homogeneous combustion process wave within the allowable residence time. One method of reducing the bleed air flow rate is to set the delta EGT set point 15-2 to the bleed valve control 15-1 to very large number, say 500° C. Alternatively, the bleed valve position can be set to zero. These temporary processes will continue for a fixed time after detecting the loss of the homogeneous combustion process wave or when the shaft output is equal to the set point; at which point the control system will operate per the normal operating schedule and closed loop control basis. The fixed time duration should be long enough to ensure the homogeneous combustion cannot re-establish itself and will depend on many parameters such as the unloading ramp rate, thermal mass of the engine, BOZ residence time.

Various novel control systems developed to date for gas turbine catalytic combustion systems may optionally utilize a fixed relationship between the a) fuel air ratio and b) the temperature of the mixture fed to the catalyst. The fuel air ratio is determined by the fuel requirements of the gas turbine and the compressor's output. A flame combustor upstream of the catalyst adjusts the temperature of the mixture. This relationship provides the ability for the turbine control system to operate during start up and at different load conditions while still maintaining the catalyst at optimum operating conditions with very low emissions.

The present additional control strategy has been developed to allow the gas turbine to operate at lower load or at other conditions where the total fuel required by the gas turbine is not optimum for full combustion of the fuel. The present invention manages air that bypasses the catalytic combustor and air that bleeds off of the compressor discharge. For example, as shown in Table D,

TABLE D

| | Bleed and Bypass Combined | | | |
|---|---|---|---|---|
| % Load | dEGT Setpoint (° C.) | Resulting Bleed Valve Position (%) | Resulting dEGT (° C.) | Resulting Bypass Valve Position (%) |
| 100 | 105 | 0 | 0 | 0 |
| 90 | 105 | 0 | 35 | 15 |
| 80 | 105 | 0 | 70 | 30 |
| 70 | 105 | 0 | 105 | 45 |
| 60 | 105 | 25 | 105 | 45 |
| 50 | 105 | 50 | 105 | 45 |
| 40 | 105 | 75 | 105 | 45 |
| 30 | 105 | 100 | 105 | 45 |
| 20 | 105 | 100 | 140 | 60 |
| 10 | 105 | 100 | 175 | 75 |
| FSNL | 105 | 100 | 210 | 90 |

when the present load decreases, the bypass valve will open to attained the scheduled Tad. As the load continues to drop the bleed valve will open to maintain the desired dEGT setpoint as shown in Table C. However, when the bleed valve is able to control to a specific dEGT setpoint, for example between 70% to 30% load shown on Table D, the bypass valve remains constant because the Tad needs to remain constant according to the dEGT versus Tad schedule of Table B. The Tad and bypass valve can remain constant while load is reduced because the fuel flow remains constant while bleeding off air which reduces the over-all turbine efficiency. The bypass system changes the fuel air ratio of the catalytic combustor without affecting the overall gas turbine power output. The bleed system also changes the fuel air ratio of the catalytic combustor but at the cost of reducing the overall gas turbine efficiency. The key advantage of a catalytic combustor with a bypass and bleed system and the inventive control strategy is that it can maintain the catalyst at optimum low emissions operating conditions over a wider load range than a catalytic combustor without such a system.

What is claimed is:

1. A method of controlling a catalytic combustion system comprising an air supply, a flame burner, a fuel injector positioned downstream of the flame burner and a catalyst positioned downstream of the fuel injector, a flow path containing a valve that directs a portion of the airflow to bypass the catalyst, wherein a portion of the fuel combusts within the catalyst and a remainder of the fuel combusts in the region downstream of the catalyst, comprising:

determining the adiabatic combustion temperature at the catalyst inlet;

measuring a load on a turbine downstream of the catalyst;

calculating full load on the turbine downstream of the catalyst;

adjusting the airflow that bypasses the catalyst to maintain the adiabatic combustion temperature at the catalyst inlet based upon a predetermined schedule that relates the i) adiabatic combustion temperature at the catalyst inlet to ii) the difference between the measured load and the calculated full load.

2. The method of claim 1, wherein the adiabatic temperature is determined by monitoring a) the airflow through the combustor, b) the fuel flow to the combustor and c) the temperature of the gas mixture entering the combustor.

3. The method of claim 2, wherein the airflow through the combustor is determined by measuring the airflow through the compressor, multiplying by the fraction of air flowing to the combustor and subtracting the airflow through the bypass.

4. The method of claim 3, wherein the airflow through the compressor is determined by measuring the pressure drop at the compressor inlet bell mouth.

5. The method of claim 1, wherein the airflow through the bypass is determined by a flow measuring device located in the bypass flow path.

6. The method of claim 5, wherein the flow measuring device consists of a restriction to the flow and a sensor to measure pressure drop across the resistance.

7. The method of claim 1, further comprising a power turbine downstream of the catalyst and a generator connected to the power turbine wherein the measured load is the output of the generator.

8. The method of claim 7, wherein the difference between the load and the calculated full load is determined from the turbine compressor discharge pressure, and exhaust gas temperature.

9. The method of claim 1, wherein the catalyst is controlled via a schedule versus fuel air ratio (at the catalyst inlet) or Tad (adiabatic combustion temperature) or EGT-delta (difference between calculated exhaust gas temperature at full load and measured exhaust gas temperature) in combination with a bypass and bleed.

10. The method of claim 1, wherein measuring the load includes measuring the exhaust gas temperature, and calculating the full load includes calculating the exhaust gas temperature at full load.

11. The method of claim 1, wherein the exhaust gas temperature is measured by a thermocouple installed in the exhaust stream.

12. The method of claim 1, wherein measuring the load includes measuring at least one thermodynamic combustion system parameter associated with the load, and calculating the full load includes calculating the at least one thermodynamic combustion system parameter associated with the load at full load.

* * * * *